US006166726A

United States Patent [19]

Uchida et al.

[11] Patent Number: 6,166,726

[45] Date of Patent: Dec. 26, 2000

[54] CIRCUIT FOR DRIVING A LIQUID CRYSTAL DISPLAY

[75] Inventors: Hideaki Uchida, Sagamihara; Kouji Ohhashi, Yokohama, both of Japan

[73] Assignee: Kabushiki Kaisha Toshiba, Kawasaki, Japan

[21] Appl. No.: 09/066,770

[22] Filed: Apr. 27, 1998

[30] Foreign Application Priority Data

Apr. 28, 1997 [JP] Japan ..... 9-110940
Jan. 23, 1998 [JP] Japan ..... 10-011676

[51] Int. Cl.[7] ..... G09G 3/36; G09G 5/00

[52] U.S. Cl. ..... 345/211; 345/204; 345/87

[58] Field of Search ..... 345/204, 211–214

[56] References Cited

U.S. PATENT DOCUMENTS 5,323,171 6/1994 Yokouchi et al. ..... 345/211
5,510,814 4/1996 Ise ..... 345/211
5,572,735 11/1996 Tanikawa ..... 345/211
5,793,346 8/1998 Moon ..... 345/211
5,859,632 1/1999 Ito ..... 345/211
5,945,970 8/1999 Moon et al. ..... 345/211
5,986,649 11/1999 Yamazaki ..... 345/211
6,005,541 12/1999 Takahashi et al. ..... 345/211

*Primary Examiner*—Bipin Shalwala
*Assistant Examiner*—David L. Lewis
*Attorney, Agent, or Firm*—Oblon, Spivak, McClelland, Maier & Neustadt, P.C.

[57] ABSTRACT

A power supply applies a power-supply voltage VDD to operate an LCD driver circuit. A booster circuit increases the power-supply voltage VDD, generating an LCD-driving voltage VLDC. When the power-supply voltage VDD is equal to or higher than a predetermined voltage, a power-supply voltage detecting circuit outputs the LCD-driving voltage VLCD to a switch circuit. The switch circuit disconnects the line for applying the voltage VLCD, from the line for applying a reference voltage GND. When the power-supply voltage VDD is lower than the predetermined voltage, the power-supply voltage detecting circuit outputs an indefinite voltage to the switch circuit. In this case, the switch circuit short-circuits the line for applying the voltage VLCD, to the line for applying the reference voltage GND. This prevents undesired phenomena, such as flickering, from occurring on the screen of the liquid crystal display, even if the application of power-supply voltage VDD is interrupted.

36 Claims, 11 Drawing Sheets

CIRCUIT FOR DRIVING A LIQUID CRYSTAL DISPLAY

BACKGROUND OF THE INVENTION

The present invention relates to a circuit for driving a liquid crystal display (LCD), which comprises a circuit for discharging an LCD-driving voltage. More particularly, the invention relates to a circuit that discharges an accumulated LCD-driving voltage when the power supply to the circuit is interrupted, thereby to prevent flickering on the screen of the liquid crystal display (LCD).

Personal apparatus developed in recent years, such as mobile telephones, are characterized in some respects. First, they are driven by a chargeable battery. Second, they have a liquid crystal display (LCD). Third, they consume less and less electric power. A circuit for driving an LCD is known which comprises an LCD drive circuit and an LCD power-supply circuit, both consumes a little electric power. This circuit will be described below.

FIG. 19 is a circuit diagram of a conventional circuit for driving a liquid crystal display.

As shown in FIG. 19, a booster circuit raises the voltage (VDD) of a signal for turning on and off a liquid crystal display LCD, converting the signal to one having an LCD-driving voltage (VLCD). The signal having the LCD-driving voltage is input to an LCD drive buffer. The buffer outputs an LCD-driving voltage or a reference voltage GND.

In the LSI incorporating this circuit for driving a liquid crystal display, a power-supply voltage VDD is applied from a power supply 100. The booster circuit 102 raises the power-supply voltage VDD, thus generating an LCD-driving voltage VLCD. The voltage VLCD is accumulated in a capacitor C100 provided for holding a voltage.

An SC signal is supplied to the circuit from an external device. The SC signal is a control signal having a VDD voltage, for turning on or off the liquid crystal display LCD. The signal SC becomes effective when a DISPOFF signal (later described) is set at low level (GND). The DISPOFF signal is used to turn off the liquid crystal display LCD, whichever level the SC signal has. To turn off the liquid crystal display LCD, the DISPOFF signal is set at high level (VDD). Both the SC signal and the DISPOFF signal are input to an OR gate circuit 104. The OR gate circuit 104 outputs the logic sum of these signals, or a signal IN. The signal IN is input to a level shifter 106.

The level shifter 106 changes the level of the signal IN, from the VDD level to the VLCD level, thereby generating a positive signal OUT. The signal OUT is input to the LCD drive buffer 108. The LCD drive buffer 108, which comprises a p-channel MOS transistor MP100 and an n-channel MOS transistor MN100, outputs a drive signal S100. The drive signal S100 has the LCD-driving voltage VLCD when the signal OUT is at the GND level, and has the reference voltage GND when the signal OUT is at the VLCD level. The drive signal S100 is input to the liquid crystal display LCD.

Namely, in order to drive the liquid crystal display LCD, a DISOFF signal at low level is input, thus validating the SC signal, and a drive signal S100 generated from the SC signal is output. On the other hand, to turn off the liquid crystal display LCD, a DISOFF signal at high level is input, thus invalidating the SC signal, and a drive signal S100 at GND level is output.

The OR gate circuit 104, level shifter 106 and LCD drive buffer 108 constitute a circuit which outputs a drive signal S100. A plurality of circuits of this type are provided in the LSI on which the circuit of FIG. 19 is mounted. It is assumed here that the power-supply voltage VDD is 1.5V, and that the booster circuit 102 raises the power-supply voltage to 4.5V, i.e., three times the voltage VDD (=VDD×3). The voltage of 4.5V, thus generated, is used as the LCD-driving voltage VLCD. The circuit of FIG. 19, thus constructed, shall be hereinafter referred to as "conventional circuit 1."

Another conventional circuit for driving a liquid crystal display will be described below.

FIG. 20 is a block diagram illustrating a circuit for driving a liquid crystal display, which incorporates an LCD drive circuit and an LCD power-supply circuit.

The circuit for driving a liquid crystal display is mounted on a large-scale integrated circuit (LSI) 50. As shown in FIG. 20, the LSI 50 has an LCD drive circuit 52 and an LCD power-supply circuit 54. The circuit 52 outputs a display signal to a liquid crystal display LCD. The circuit 54 generates an LCD-driving voltage VLCD and applies the same to the LCD drive circuit 52.

The LCD power-supply circuit 54 is a booster circuit whose output contains no DC pulses and which consumes but a little power. Capacitors C110, C111 and C112 are arranged outside the LSI 50. The capacitors accumulate electric charge to provide an increased current capacity.

In the LSI 50 having the above-described circuit for driving the LCD, a power-supply voltage VDD generated by an external device is applied to the LCD power-supply circuit 54. The circuit 54 generates three voltages V1, V2 and V3 from the power-supply voltage VDD. The voltages V1, V2 and V3 are applied to the LCD drive circuit 52 and are also accumulated in the capacitors C110, C111 and C112, respectively. The power-supply voltage VDD is 5V, and the voltages V1, V2 and V3 are 1V, 2V and 3V, respectively. The circuit of FIG. 20, thus constructed, shall be hereinafter referred to as "conventional circuit 2."

With small communications apparatus, such as a PHS (Personal Handyphone System) and a mobile telephone, it is necessary to reduce power consumption. To this end, power supply to the LSI incorporating the above-described LCD-driving circuit must be interrupted to save power. With such small communications apparatus it is necessary to replace the battery with a new one when the battery is used up. These apparatus are so designed that the battery can be replaced very easily. In many cases, the user may abruptly remove the battery from the apparatus.

How the conventional circuit 1 (FIG. 19) operates when the application of the voltage VDD is interrupted will be explained, with reference to FIGS. 3, 4, 21 and 22.

FIG. 21 is a circuit diagram of the level shifter 106. The level shifter is of the ordinary type. It comprises p-channel MOS transistors MP101 to MP105 and n-channel transistors MN101 to MN105. As mentioned above, the LCD-driving voltage VLCD is 4.5V.

The level shifter 106 operates in one way when the power-supply voltage VDD ranges from 0.5 to 1.5V, and in another way when the voltage VDD is less than 0.5V.

When the power-supply voltage VDD applied from the power supply 100 is 0.5 to 1.5V, the signal IN input to the level shifter 106 and the signal OUT output therefrom have the relation shown in FIG. 3. In this case, the level shifter 106 operates normally.

When the power-supply voltage VDD is less than the lowest operating voltage VDDmin of 0.5V, the voltage on the output lines a and b of the inverter composed of the transistors MP101, MN101, MP102 and MN102 becomes indefinite. Consequently, the transistors MN103 and MN104 have an indefinite gate bias voltage (less than 0.5V) and an extremely high on-resistance. This renders the voltage on the line C indefinite. A current inevitably passes through the path between the transistor MN105 and the transistor MP105.

As a consequence, the signal OUT output from the level shifter 106 comes to have an indefinite value, too. At this time, the signal IN an the signal Out have the relation shown in FIG. 4. As can be understood from FIG. 4, the signal OUT is always indefinite.

Hence, when the power-supply voltage VDD falls below 0.5V, i.e. the lowest operating voltage VDDmin of the level shifter 106, in the conventional LCD-driving circuit, the signal OUT, i.e. the output of the level shifter 106, becomes indefinite. If so, the gate biases of the transistors MN100 and MP100 become indefinite.

As a consequence, a current passes through the path between the transistors MN100 and MP100, and the drive signal S100 output from the LCD drive buffer 108 becomes indefinite (about 2 to 3V), failing to acquire the ground level (0V). A voltage is inevitably applied to the liquid crystal display LCD. As a result, an undesired phenomenon, such as flickering, will take place on the screen of the display LCD.

FIG. 22 illustrates how the voltages VLCD and VDD change when the application of the power-supply voltage VDD is interrupted after the liquid crystal display LCD has been turned off (that is, after the booster circuit 102 has been turned off). As seen from FIG. 22, the voltage VDD falls along a steep slope to a value near the GND level (0V) after the application of the power-supply voltage VDD has been interrupted. By contrast, the voltage VLCD falls along a gentle slope toward the GND level since the capacitor C100 holds the voltage VLCD.

Therefore, a current passes through the path between the transistors MN100 and MP100 for a period tA, whereby a voltage is applied to the liquid crystal display LCD, by virtue of the drive signal S100. Since the electric charge is fast dissipated from the capacitor C100 for a certain period, the slope of the LCD-driving voltage VLCD is steep for the period tA only. Generally, the liquid crystal is momentarily driven if a voltage is applied on it for the period tA as is illustrated in FIG. 22, whereby the liquid crystal display LCD is turned on (it displays data). The value of the voltage at which the display LCD is turned on depends on the type of the liquid crystal used in the display LCD.

How the conventional circuit 2 (FIG. 20) operates when the chargeable battery is removed, that is, when the application of the power-supply voltage VDD is interrupted, will be explained, with reference to FIG. 23.

FIG. 23 illustrates how the power-supply voltage VDD and the LCD-driving voltage VLCD change when the application of the power-supply voltage VDD is interrupted in the LSI 50.

When a chargeable battery is abruptly removed from, for example, a mobile telephone incorporating the LSI 50, the power-supply voltage VDD quickly falls to the reference voltage GND as is illustrated in FIG. 23.

At the same time, the LCD-driving voltages V1, V2 and V3, all generated in the LCD power-supply circuit 54, start falling. How much the voltages V1, V2 and V3 fall is determined by the leakage current, because the conventional circuit 2 has no DC path.

When the power-supply voltage VDD falls below the lowest operating voltage of the LSI 50, the components of the LSC 50 can no longer be controlled. The conventional circuit 2 inevitably makes errors. Nonetheless, no particular problem arises if the LCD-driving voltages V1, V2 and V3 have fallen to a very small value. If the voltages V1, V2 and V3 fall too slowly, however, a high DC voltage will be applied to the liquid crystal display LCD, momentarily turning on the same. Consequently, flickering occurs or a streak is displayed, on the screen of the liquid crystal display LCD.

As described above, the conventional LCD-driving circuits apply a LCD-driving voltage VLCD accumulated in the voltage-holding capacitors, to a liquid crystal display LCD, when the power-supply voltage VDD falls below the lowest operating voltage. The voltage VLCD thus applied causes undesirable phenomena, such as flickering, on the screen of the liquid crystal display LCD.

BRIEF SUMMARY OF THE INVENTION

The object of the present invention is to provide a circuit for driving a liquid crystal display, in which a path is formed to discharge an electric charge from a capacitor accumulating an LCD-driving voltage, thereby to prevent the LCD-driving voltage from being applied to the display and, thus, to prevent undesired phenomena, such as flickering, from occurring on the screen of the display.

To achieve the object, a circuit for driving a liquid crystal display is provided according to the invention, which comprises: voltage-generating means, power-supply detecting means, a first line, a second line, and switch means. The voltage-generating means generates, from a power-supply voltage, an LCD-driving voltage which drives liquid crystal incorporated in a liquid crystal display. The power-supply detecting means detects whether the power-supply voltage is lower than a predetermined voltage. The first line is connected to the voltage-generating means, for applying the LCD-driving voltage. The second line is connected to the voltage-generating means, for applying a reference voltage. The switch means disconnects the first line from, or short-circuits the same to, the second line, in response to an output of the power-supply detecting circuit.

A circuit for driving a liquid crystal display is provided according to the invention, which comprises: voltage-generating means, power-supply detecting means, a first line, a second line, and switch means. The voltage-generating means generates, from a power-supply voltage, an LCD-driving voltage which drives liquid crystal incorporated in a liquid crystal display. The power-supply detecting means detects whether the power-supply voltage is lower than a predetermined voltage. It outputs a first signal when the power-supply voltage is equal to or higher than the predetermined voltage, and a second signal when the power supply voltage is lower than the predetermined voltage. The first line is connected to the voltage-generating means, for applying the LCD-driving voltage. The second line is connected to the voltage-generating means, for applying a reference voltage. The switch means disconnects the first line from the second line in response to the first signal output from the power-supply detecting circuit, and short-circuits the same to the second line in response to the second signal output from the power-supply detecting circuit.

In either circuit according to the invention, the switch means forms a conducting path between the first and second lines when the application of the power-supply voltage is interrupted. The electric charge is instantaneously discharged from a capacitor provided on the first line, through the conducting path.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described, with reference to the accompanying drawings.

Figure 1:
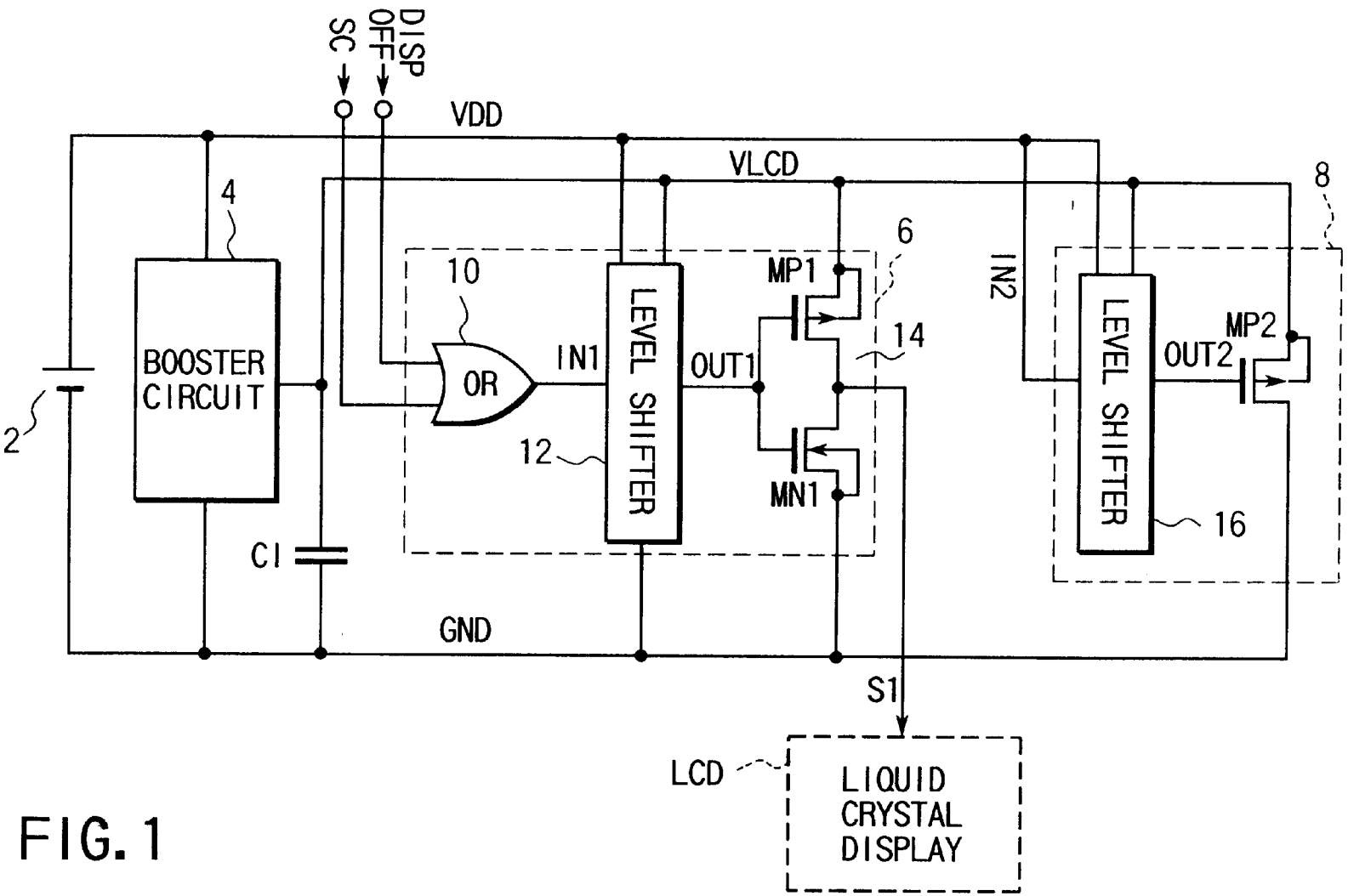
FIG. 1 is a diagram illustrating an LCD-driving circuit according to a first embodiment of the invention.

FIG. 1 is a diagram illustrating an LCD-driving circuit according to the first embodiment of the invention.

As shown in FIG. 1, the LCD-driving circuit comprises a power supply 2, a booster circuit 4, a capacitor C1, a drive circuit 6, and a discharge circuit 8. The power supply 2 supplies a power-supply voltage VDD. The booster circuit 4 is connected between a line for applying the power-supply voltage VDD (hereinafter called "VDD line") and a line for applying a reference voltage GND (hereinafter called "GND line"). The booster circuit 4 is designed to raise the power-supply voltage VDD, thereby generating a LCD-driving voltage VLCD. The output of the booster circuit 4 is connected to a line for applying the voltage VLCD (hereinafter called "VLCD line"). The capacitor C1 is connected between the VLCD line and the GND line, for reliably applying the LCD-driving voltage VLCD to the drive circuit 6. The drive circuit 6 is connected to the VDD line, VLCD line and GND line, for supplying a drive signal S1 to a liquid crystal display LCD. The discharge circuit 8 is connected to the VDD line, VLCD line and GND line, for discharging the LCD-driving voltage VLCD from the voltage-holding capacitor C1.

An SC signal and a DISPOFF signal are input to the drive circuit 6 from an external device. The SC signal turns on or off the liquid crystal display LCD. The DISPOFF signal turns off the liquid crystal display LCD, regardless of the level of the SC signal.

The drive circuit 6 comprises an OR gate circuit 10 and a level shifter 12. The OR gate circuit 10 generates a logic sum of the SC signal and the DISPOFF signal. The level shifter 12 receives the signal IN1 of the VDD level from the OR gate circuit 10, converts the same to a signal of the voltage VCL and inverts this signal to a positive-level signal OUT1. The drive circuit 6 further comprises a LCD drive buffer 14. The buffer 14 comprises a p-channel MOS transistor MP1 and an n-channel MOS transistor NM1.

The LCD drive buffer 14 outputs a drive signal S1 at the LCD-driving voltage VLDC to the liquid crystal display LCD when the signal OUT1 input to the gates of the p-channel MOS transistor MP1 and n-channel MOS transistor MN1 is at the reference voltage GND. When the signal OUT1 is at the LCD-driving voltage VLCD, the LCD drive buffer 14 outputs a signal S1 at the reference voltage GND. Although only one drive circuit 6 is shown in FIG. 1, at least one other drive circuit of the identical structure is provided in the LCD-driving circuit. Each of the drive circuits is connected to the VDD line, VLCD line and GND line.

The discharge circuit 8 comprises a left shifter 16 and a p-channel MOS transistor MP2. The left shifter 16 is connected at its input to the power supply 2, receiving the power-supply voltage VDD, and also receives a signal IN2. The p-channel MOS transistor MP2 receives at its gate a signal OUT2 output from the level shifter 16, and receives the LCD-driving voltage VLCD at its source and back gate. The level shifter 12 has the same structure as the left shifter 12 described above.

Figure 2:
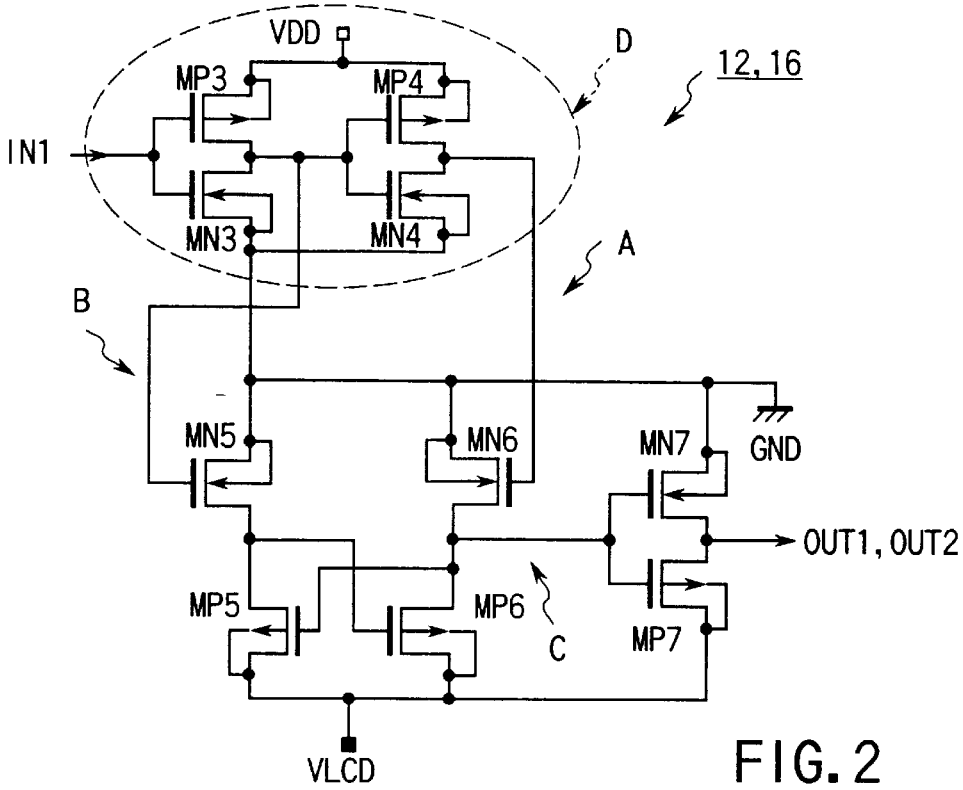
FIG. 2 is a circuit diagram of the level shifters 12 and 16, both provided in the circuit shown in FIG. 1.

The level shifters 12 and 16 provided in the drive circuit 6 and discharge circuit 8, respectively, are of the ordinary type use widely. FIG. 2 is a circuit diagram of the level shifters 12 and 16 identical in structure. As shown in FIG. 2, the level shifters 12 and 15 comprise p-channel MOS transistors MP3 to MP7 and n-channel MOS transistors MN3 to MN7.

The operation of the LCD-driving circuit according to the first embodiment will be explained.

In the LSI incorporating the LCD-driving circuit, the power supply 2 applies the power-supply voltage VDD to the booster circuit 4. The booster circuit 4 raises the voltage VDD, generating the LCD-driving voltage VLCD. The LCD-driving voltage VLCD is held in the voltage-holding capacitor C1 and stabilized. The voltage VLCD, rendered stable, is applied to the drive circuit 6.

In the drive circuit 6, the SC signal externally input is a control signal of VDD system, which turns on or off the liquid crystal display LCD. The SC signal is effective as long as the DISPOFF signal (later described in detail) remains at the low level (i.e., reference voltage GND). The DISPOFF signal turns off the liquid crystal display LCD, no matter whichever level the SC signal has. The DISPOFF signal turns off the liquid crystal display LCD, regardless of the level of the SC signal, when it is set at the high level (i.e., power-supply voltage VDD). Both the SC signal and the DISPOFF signal are input to the OR gate circuit 10. The OR gate circuit 10 generates a logic sum of the input signals. The logic sum is output as signal IN1 to the level shifter 12.

The level shifter 12 converts the signal IN1 (i.e., the output signal of the OR gate circuit 10) to a signal of the VLCD-system level and inverts the same to a positive-level signal OUT1. The signal OUT1 is input to the LCD drive buffer 14. The buffer 14, which comprises the p-channel MOS transistor MP1 and n-channel MOS transistor MN1, applies the LCD-driving voltage VLCD as a drive signal S1 to the liquid crystal display LCD when the signal OUT1 is at the reference voltage GND. When the signal OUT 1 is at the LCD-driving voltage VLCD, the buffer 14 applies the reference voltage GND as a drive signal S1 to the liquid crystal display LCD.

In the drive circuit wherein signals are thus processed, a DISPOFF signal at the low level is input, validating the SC signal, in order to cause the liquid crystal display LCD to display data. The LDC driver 14 generates a drive signal S1 on the basis of the SC signal. The drive signal S1 is supplied to the liquid crystal display LCD, which displays data. In order to turn off the liquid crystal display LCD, a DISPOFF signal at the high level is input, invalidating the SC signal. In this case, the LCD driver buffer 14 generates a drive signal S1 fixed at the reference voltage VDD, and the signal S1 turns off the liquid crystal display LCD. As mentioned above, at least one drive circuit other than the circuit 6 shown in FIG. 1 is also provided, along with the circuit 6, in the LSI incorporating the LCD-driving circuit. Like the drive circuit 6, the other driver circuit comprises an OR gate 10, a level sifter 12 and an LCD drive buffer 14.

The operation of the discharge circuit 8 will be explained.

In the LCD-driving circuit shown in FIG. 1, the power-supply voltage VDD and the LCD-driving voltage VLCD are 1.5V and 4.5V, respectively, as in the conventional circuit 1. The booster circuit 4 raises the power-supply voltage VDD to 4.5V, which is three times the voltage VDD (=VDD×3). The voltage of 4.5V, thus generated, is used as the LCD-driving voltage VLCD. The lowest operating voltage VDDmin of the level shifter 16 is 0.5V. It will be described how the discharge circuit 8 operates when the power-supply voltage VDD is 0.5 to 1.5V, and how the circuit 8 operates when the voltage VDD is less than the lowest operating voltage VDDmin (0.5V), while the LCD-driving voltage VLDC remains at 4.5V.

Figure 3:
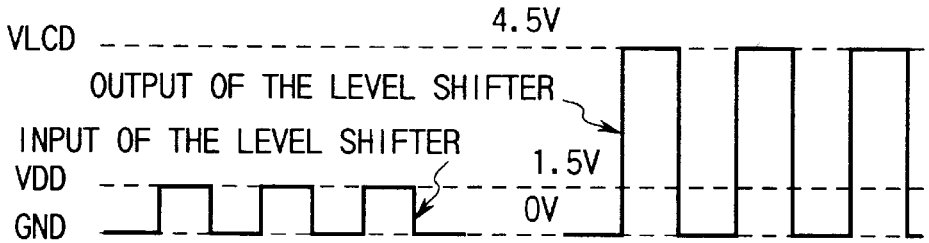
FIG. 3 is a chart showing the signals which are input to, and output from, the level shifter 16 when the power-supply voltage VDD ranges from 0.5V to 1.5V.

When the power-supply voltage VDD applied from the power supply 2 is 0.5 to 1.5V, the signals IN2 and OUT2, respectively, input to and output from the level shifter 16 have the relation illustrated in FIG. 3. As seen from FIG. 3, the level shifter normally operates, generating a signal OUT2 at the LCD-driving voltage VLCD (i.e., 4.5V). The LCD-driving voltage VLCD of 4.5V is applied to the gate of the transistor MP2, changing the gate bias thereof to 0V. The transistor MP2 is thereby turned off. No conducting path is formed between the source and drain of the transistor MP2. The LCD-driving voltage VLCD remains held in the capacitor C1.

On the other hand, when the power-supply voltage VDD applied from the power supply 2 is less than 0.5V, i.e., the lowest operating voltage VDDmin, the voltage on lines A and B, which is the output of the inverter composed of the transistors MP3, MN3, MP4 and MN4, becomes indefinite. The gate biases of the transistors MN5 and MN6 therefore become indefinite (less than 0.5V). The transistors MN5 and MN6 have their on-resistance increased very much.

Figure 4:
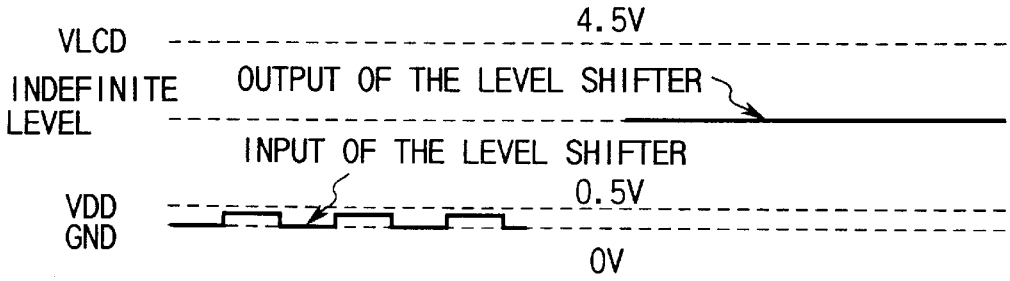
FIG. 4 is a chart illustrating the signals which are input to, and output from, the level shifter 16 when the power-supply voltage VDD is less than the lowest operating voltage VDDmin (0.5V) of the level shifter 16.

Hence, the voltage on a line C becomes indefinite, too. A current passes through the path between the transistors MN7 and MP7. As a result, the signal OUT2 output from the level shifter 16 becomes indefinite in terms of voltage. At this time, the signals IN2 and OUT2, respectively input to and output from the level shifter 16, have the relation shown in FIG. 4. As can be understood from FIG. 4, the signal OUT2 is indefinite as long as the power-supply voltage VDD is lower than the lowest operating voltage VDDmin of the level shifter 16.

Therefore, when the power-supply voltage VDD falls below the lowest operating voltage VDDmin (0.5V) in the LCD-driving circuit, the signal OUT2 output from the level shifter 16 becomes indefinite, rendering the gate bias of the transistor M2 indefinite. The transistor MP2 is therefore turned on, developing a conducting path between the source and drain. Consequently, the VLCD line is short-circuited to the GND line.

Figure 5:
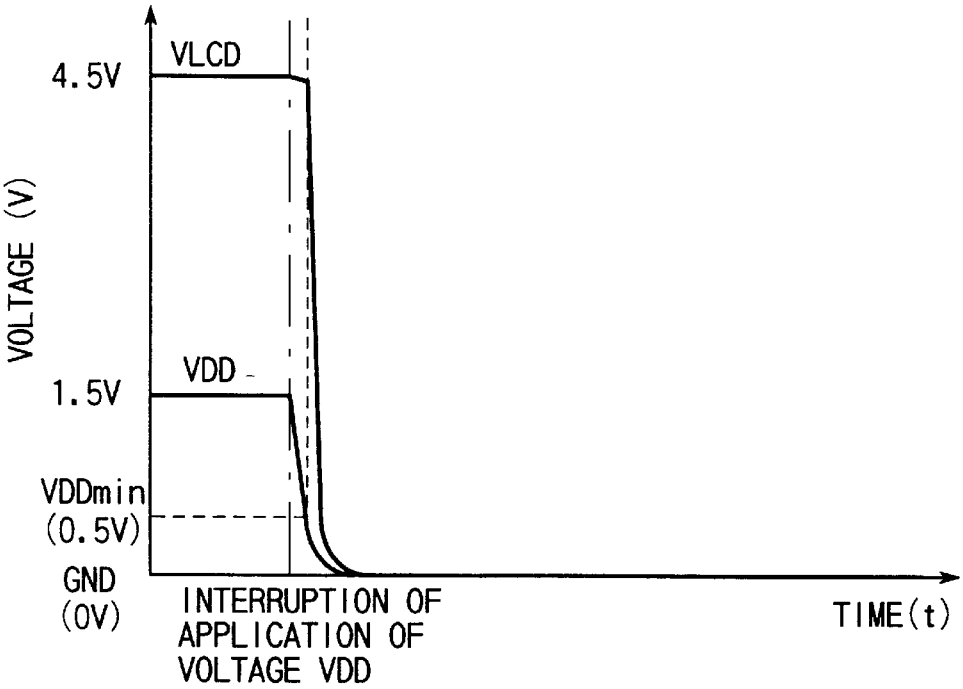
FIG. 5 is a chart explaining how the LCD-driving voltage VLCD and the power-supply voltage VDD change when the application of the voltage VDD is interrupted after the display LCD (FIG. 1) has been turned off.

FIG. 5 shows how the LCD-driving voltage VLCD and the power-supply voltage VDD change when the application of the voltage VDD is interrupted after the display LCD has been turned off. In FIG. 5, both voltages VLCD and VDD are plotted on the Y axis, whereas time is plotted on the X axis. As FIG. 5 indicates, the transistor MP2 is turned on when voltage VDD falls below the lowest operating voltage VDDmin of the level shifter 16 after the application of the voltage VDD has been interrupted. The moment the transistor MP2 is turned on, the electric charge is discharged from the capacitor C1. The LCD-driving voltage VLCD therefore quickly falls to a value near the reference voltage GND (0V). This prevents the drive circuit 6 from applying a voltage, in the form of a drive signal S1, to the liquid crystal display LCD.

As described above, a path is formed to discharge the electric charge from the capacitor which holds the LCD-driving voltage, when the application of the power-supply voltage is interrupted. Thus, the LCD-driving voltage is not applied to the liquid crystal display in the event of said interruption. The first embodiment of the invention can therefore prevent undesired phenomena, such as flickering, from occurring on the screen of the liquid crystal display.

An LCD-driving circuit, which is the second embodiment of the invention, will be described.

The second embodiment is identical in structure to the first embodiment, except that a level shifter 20 is used in place of the level shifter 16. The level shifter 20 will be described, with reference to FIG. 6.

Figure 6:
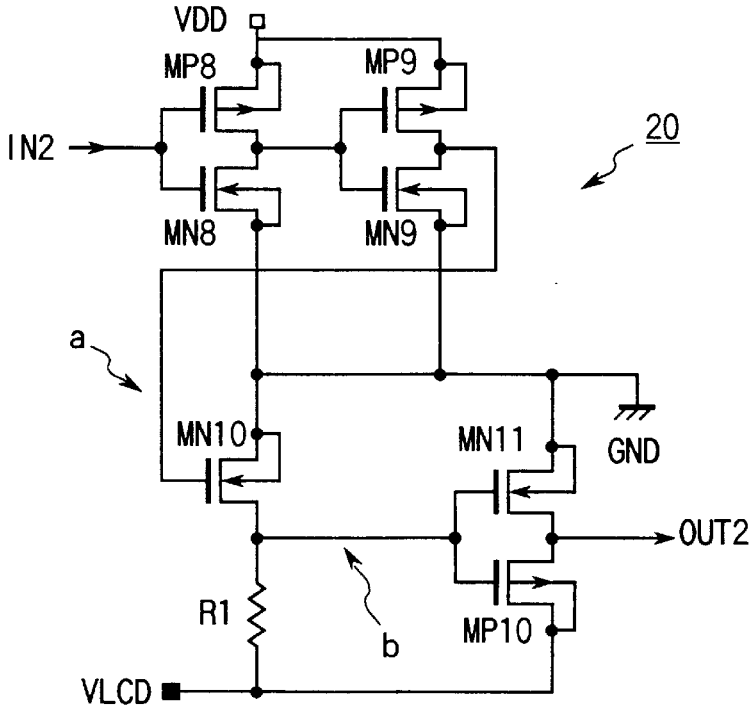
FIG. 6 is a circuit diagram of the level shifter 20 incorporated in an LCD-driving circuit according to a second embodiment of the invention.

FIG. 6 is a circuit diagram of the level shifter 20. As illustrated in FIG. 6, the level shifter 20 comprises p-channel MOS transistors MP8 to MP10, n-channel MOS transistors MN8 to MN11, and a resistor element R1. The transistors MP8 and MN8 constitute an inverter circuit. The input of the inverter circuit is connected to the power supply 2 (not shown). The power supply 2 supplies a signal IN2 to the inverter circuit. The output of the inverter circuit is connected to the gate of the transistor MN10 by the inverter circuit composed of the transistors MP9 and MN9.

The drain of the transistor MN10 is connected by a resistor element R1 to the VLCD line, and is also connected to the input of the inverter circuit composed of the transistor MP10 and MN11. The output of this inverter circuit is connected to the gate of the transistor MP2.

The sources of the transistors MP8 and MP9 and the back gates thereof are connected to the VDD line. The source and back gate of the transistor MP10 are connected to the VLCD line. The sources and back gates of the transistors MN8 to MN11 are connected to the GND line.

The operation of the level shifter 20 shown in FIG. 6 will be explained. As in the first embodiment, the power-supply voltage VDD, the LCD-driving voltage VLCD, and the lowest operating voltage VDDmin of the level shifter 20 are 1.5V, 4.5V, and 0.5V. Of these voltages, VLDC and VDDmin are fixed at 4.5V and 0.5V, respectively.

A MOS transistor has a threshold voltage specific to it. If the gate bias falls below the threshold voltage, the on-resistance of the MOS transistor will sharply increase. In view of this characteristic of a MOS transistor, it is assumed that the transistor MN10 has a threshold voltage of 0.8V. Then, RN<<R1 when the gate bias of the transistor MN10 is 0.8V or more, and RN>>R1 when the gate bias thereof is less than 0.8V, where RN is the on-resistance of the transistor MN10 and R1 is the resistance of the resistor element R1. It will be explained how the level shifter 20 operates when the power-supply voltage VDD is 0.5 to 1.5V. Also will it be described how the shifter 20 operates when the voltage VDD is less than 0.5V.

Figure 7:
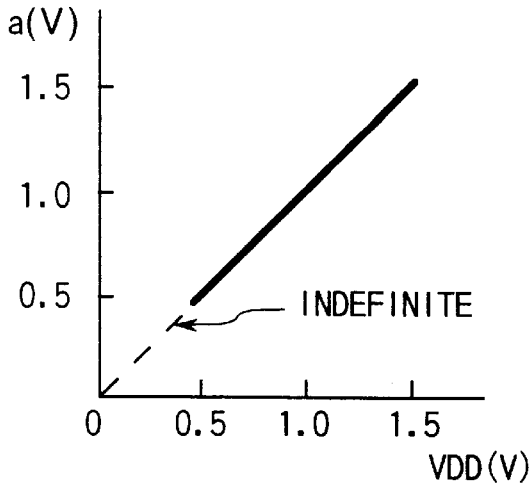
FIG. 7 is a graph showing how the voltage on the line a changes with the power-supply voltage VDD applied to the level shifter 20.
Figure 8:
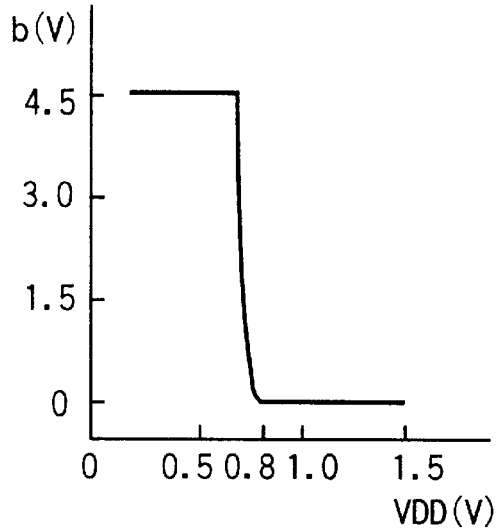
FIG. 8 is a graph illustrating how the voltage on the line b changes with the power-supply voltage VDD applied to the level shifter 20.

The voltage applied to the inverter circuit composed of the transistors MP8 and MN8 and also to the inverter circuit composed of the transistors MP9 and MN9 is equal to the voltage on the line a when the power-supply voltage VDD is 0.5 to 1.5V. This is because the lowest operating voltage VDDmin of the level shifter 20 is 0.5V. When the power-supply voltage VDD is less than 0.5V, the voltage the line a becomes indefinite. FIG. 7 shows these changes in the voltage on the line a. Namely, it is a graph illustrating how the voltage changes with the power-supply voltage VDD applied to the level shifter 20. The voltage on the line b depends on the gate bias of the transistor MN10. It is almost equal to the reference voltage GND (0V) when the power-supply voltage VDD is 0.8 to 1.5V, and is about 4.5V when the voltage VDD is less than 0.8V. FIG. 8 depicts these changes in the voltage on the line b. That is, it is a graph illustrating how the voltage changes with the power-supply voltage VDD applied to the level shifter 20.

Figure 9:
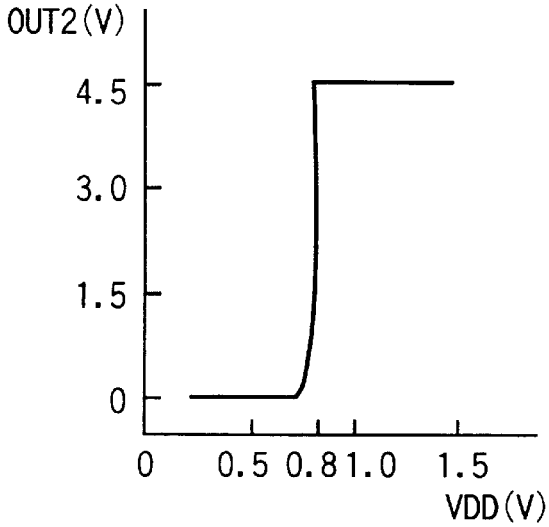
FIG. 9 is a graph depicting how the voltage of the signal OUT changes with the power-supply voltage VDD applied to the level shifter 20.

The inverter circuit, which is composed of the transistor MP10 and MN10 receiving the voltage on the line b at their gates, generates a signal OUT2. As can be understood from FIG. 9, the signal OUT2 is opposite in phase to the voltage on the line b, which is shown in FIG. 8. In other words, the signal OUT2 is nearly equal to the reference voltage GND when the power-supply voltage VDD is less than 0.8V, and is approximately 4.5V when the voltage VDD is 0.8 to 1.5V.

Hence, when the power-supply voltage VDD is less 0.8V, the gate input of the transistor MP2 is at the reference voltage GND (0V), and the transistor MP2 is turned on. The source-drain path of the transistor MP2 becomes conducting, whereby the VLCD line is short-circuited to the GND line.

Figure 10:
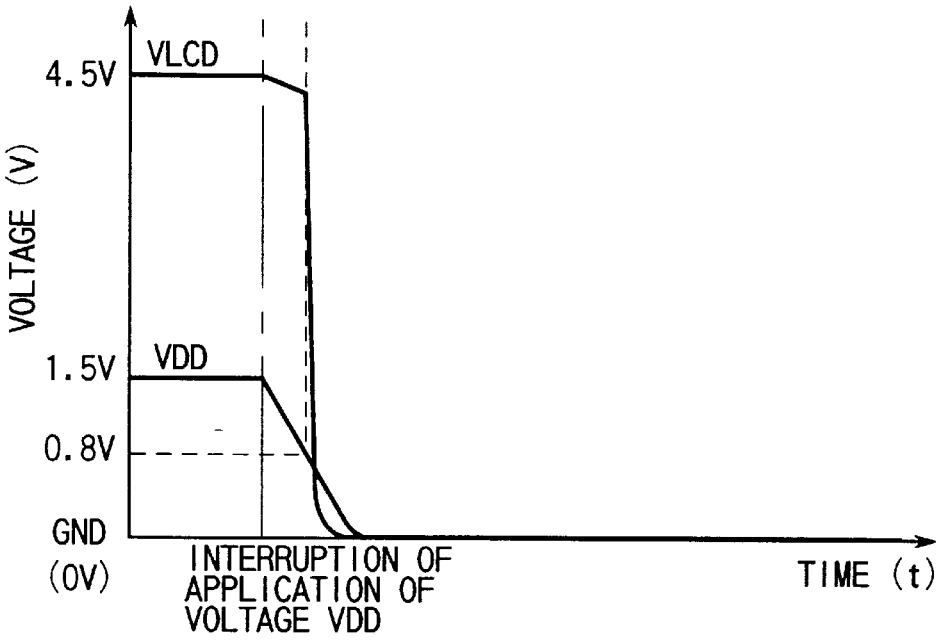
FIG. 10 is a graph explaining how the LCD-driving voltage VLCD and the power-supply voltage VDD change when the application of the voltage VDD is interrupted in the second embodiment after a liquid crystal display has been turned off.

FIG . 10 is a graph explaining how the LCD-driving voltage VLCD and the power-supply voltage VDD change when the application of the voltage VDD is interrupted in the second embodiment after the liquid crystal display LCD has been turned off. In FIG. 10, both voltages VLCD and VDD are plotted on the Y axis, and time is plotted on the X axis. As is clear from FIG. 10, the transistor MP2 is turned on, discharging an electric charge from the capacitor C1, when the voltage VDD falls below the lowest operating voltage VDDmin of the level shifter 20 after the display has been turned off. As a result, the LDC-driving voltage VLCD instantaneously falls to a value near the reference voltage GND (0V). The drive circuit 6 is thereby prevented from generating and supplying a signal S1 to the liquid crystal display LCD. Thus, no voltage is applied to the liquid crystal display LCD.

In the second embodiment, a path is formed to discharge the electric charge accumulated in the capacitor for holding the LCD-driving voltage, whenever the application of the power-supply voltage is interrupted. Hence, the LCD-driving voltage would not be applied to the liquid crystal display, once the application of the power-supply voltage has been interrupted. This prevents undesired phenomena, such as flickering, from occurring on the screen of the liquid crystal display.

An LCD-driving circuit, which is the third embodiment of the present invention, will be described.

Figure 11:
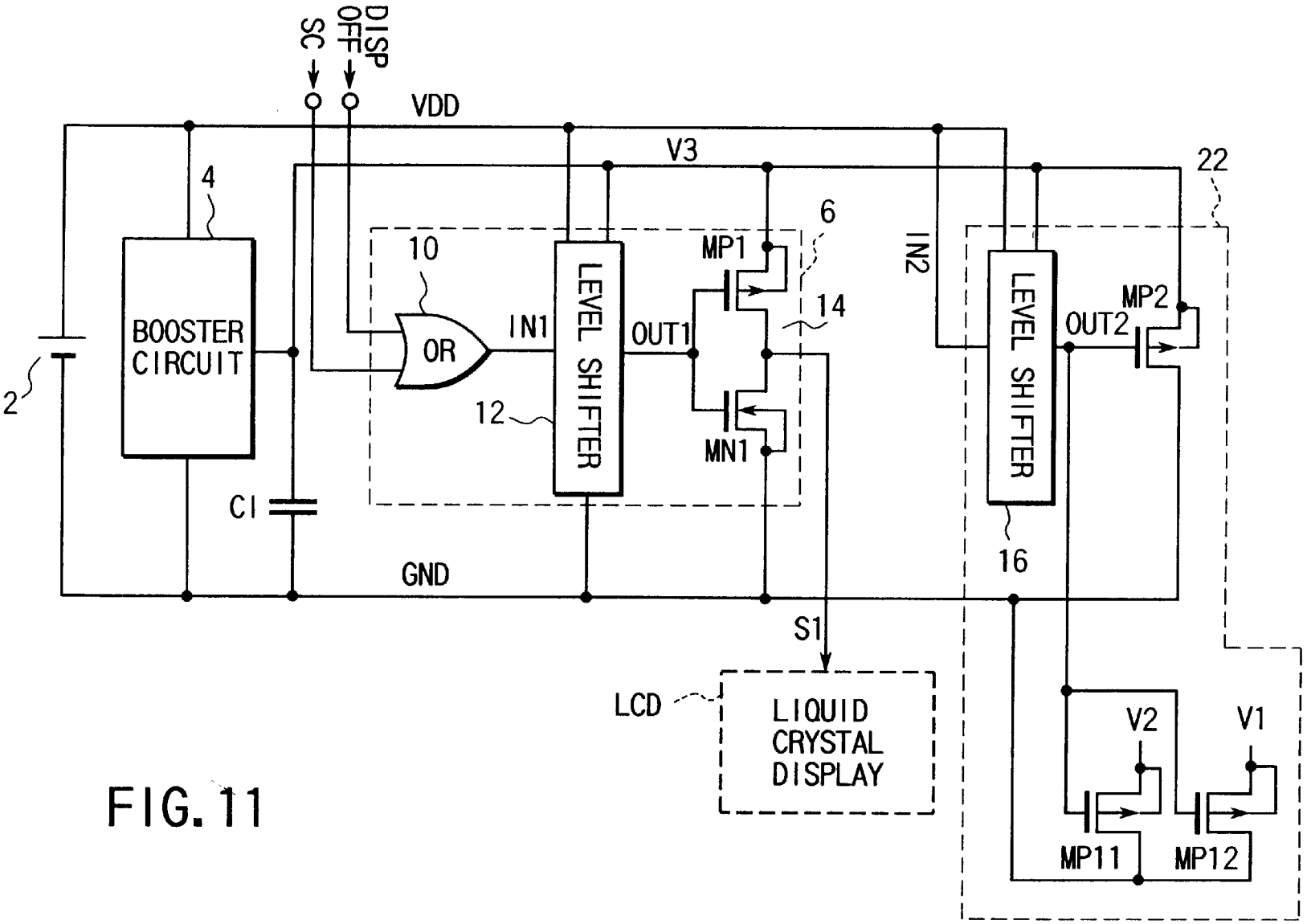
FIG. 11 is diagram showing an LCD-driving circuit according to a third embodiment of the invention.

FIG. 11 is diagram showing the LCD-driving circuit according to the third embodiment. The third embodiment is identical to the first embodiment, except that three different LCD-driving voltages V1, V2 and V3 are used instead of a single LCD-driving voltage VLCD. The third embodiment incorporates a discharge circuit 22 designed to generate the three LCD-driving voltages V1, V2 and V3. The discharge circuit 22 will be described below.

As shown in FIG. 11, the discharge circuit 22 comprises a level shifter 16 and a p-channel MOS transistor MP2. The level shifter 16 has its input connected to a power supply 2 and is designed to receive a signal IN2. The p-channel MOS transistor MP2 has its gate connected to receive a signal OUT2 output from the level shifter 16, its source and back gate connected to a booster circuit 4 to receive the voltage V3, and its drain connected to the GND line which applies reference voltage GND. It should be noted that the level shifter 16 is of the same structure as the level shifter 12 shown in FIG. 2.

The discharge circuit 22 further comprises p-channel MOS transistors MP11 and MP12. The transistor MP11 has its gate connected to receive a signal OUT2 output from the level shifter 16, its source and back gate connected to receive the voltage V2, and its drain connected to the GND line which applies reference voltage GND. The transistor MP12 has its gate connected to receive the signal OUT2, its source and back gate connected to receive the voltage V1, and its drain connected to the GND line.

The operation of the discharge circuit 22 will be explained.

In the third embodiment, the power-supply voltage VDD and the LCD-driving voltage VLCD are 1.5V and 4.5V, respectively, as in the conventional circuit 1. The booster circuit 4 raises the power-supply voltage VDD to 4.5V, which is three times the voltage VDD. The voltage of 4.5V, thus generated, is used as LCD-driving voltage VLCD. The lowest operating voltage VDDmin of the level shifter 16 is 0.5V. It will be described how the discharge circuit 8 operates when the power-supply voltage VDD is 0.5 to 1.5V, and how the circuit 8 operates when the voltage VDD is less than the lowest operating voltage VDDmin (0.5V), while the LCD-driving voltage VLDC remains at 4.5V.

When the power-supply voltage VDD applied from the power supply 2 is 0.5 to 1.5V, the signals IN2 and OUT2, respectively, the level shifter 16 operates normally, and outputs a signal OUT2 which has an LCD-driving voltage V3 of 4.5V. The voltage V3 (4.5V) is app lied to the gate of the transistor MP2, changing the gate bias of the transistor MP2 to 0V. The transistor MP2 is thereby turned off. No conducting path is therefore formed between the source and drain of the transistor MP2. The LCD-driving voltage v3 remains held in the capacitor C1.

The voltage V3 (4.5V) is applied also to the gate of the p-channel MOS transistor MP12. The gate bias of the transistor MP12 is thereby changed to 0V, and the transistor MP12 is turned off. Therefore, no conducting path is formed between the source and drain of the transistor MP12. The LCD-driving voltage V1 remains held.

When the power -supply voltage VDD applied from the power supply 2 is less than the lowest operating voltage VDDmin (0.5V) of the level shifter 12, the voltages on the lines A and B, which are the output of the inverter circuit composed of transistors NP3 and MN3, become indefinite. (The inverter circuit is a region that encircled by a broken line D in FIG. 2.) The gate biases of the transistors MN5 and MN6 therefore become indefinite, being less than 0.5V. The on-resistances of these transistors MN5 and MN6 increase very much. The voltage on the line C becomes indefinite, too, and a current passes through the path between the transistors MN7 and MP7. As a result, the signal OUT2, which has been output from the level shifter 16, becomes indefinite, too.

In the LCD-driving circuit according to the third embodiment, the signal OUT2, which is the output signal of the level shifter 16, becomes indefinite when the power-supply voltage VDD falls below the lowest operating voltage VDDmin of the level shifter 16. At this time, the gate bias of the transistor MP2 becomes indefinite, too. Hence, the transistor MP2 is turned on, and a conducting path is formed between the source and drain of the transistor MP2. The line which applies the voltage V2 is short-circuited to the GND line. Similarly, the gate bias of the p-channel MOS transistor MP12 becomes indefinite, turning on the transistor MP12. A conductive path is formed between the source and drain of the transistor MP12. The line which applies the LCD-driving voltage V1 is short-circuited to the GND line.

That is, the transistors MP2, MP11 and MP12 are turned on when the power-supply voltage VDD falls below the lowest operating voltage VDDmin (0.5V) of the level shifter 16 after the application of the voltage VDD has been interrupted. The electric charges accumulated in the capacitor C1 and the two capacitors (not shown) holding the voltages V1 and V2, respectively, are therefore discharged. The LCD-driving voltages V3, V2 and V1 are thereby lowered to values near the reference voltage GND (i.e., 0V). This prevents the drive circuit 6 from generating and supplying a signal S1 to the liquid crystal display LCD. No voltage is therefore applied to the liquid crystal display LCD.

As described above, a path is formed in the third embodiment when the application of the power-supply voltage is interrupted, thereby to discharge the electric charge from the capacitor holding the LCD-driving voltage. In this case, the LCD-driving voltage is not applied to the to the liquid crystal display. Hence, it is possible to prevent undesired phenomena, such as flickering, from occurring on the screen of the liquid crystal display.

In the third embodiment, the level shifter 16 may be replaced by the level shifter 20 (FIG. 6) for use in the second embodiment. If the third embodiment incorporates the level shifter 20, too, it can achieve the same advantages as mentioned above.

The LCD-driving circuits according to the first to third embodiments described above are of the type that is formed on an p-type semiconductor substrate. The present invention is not limited to LCD-driving circuits of this type. Rather, the invention can be applied to an LCD-driving circuits to be formed on an n-type semiconductor substrate. If this is the case, it suffices to replace the p-channel MOS transistors with p-channel MOS transistors.

An LCD-driving circuit according to the fourth embodiment of the invention will be described, with reference to FIGS. 12, 13 and 14.

Figure 12:
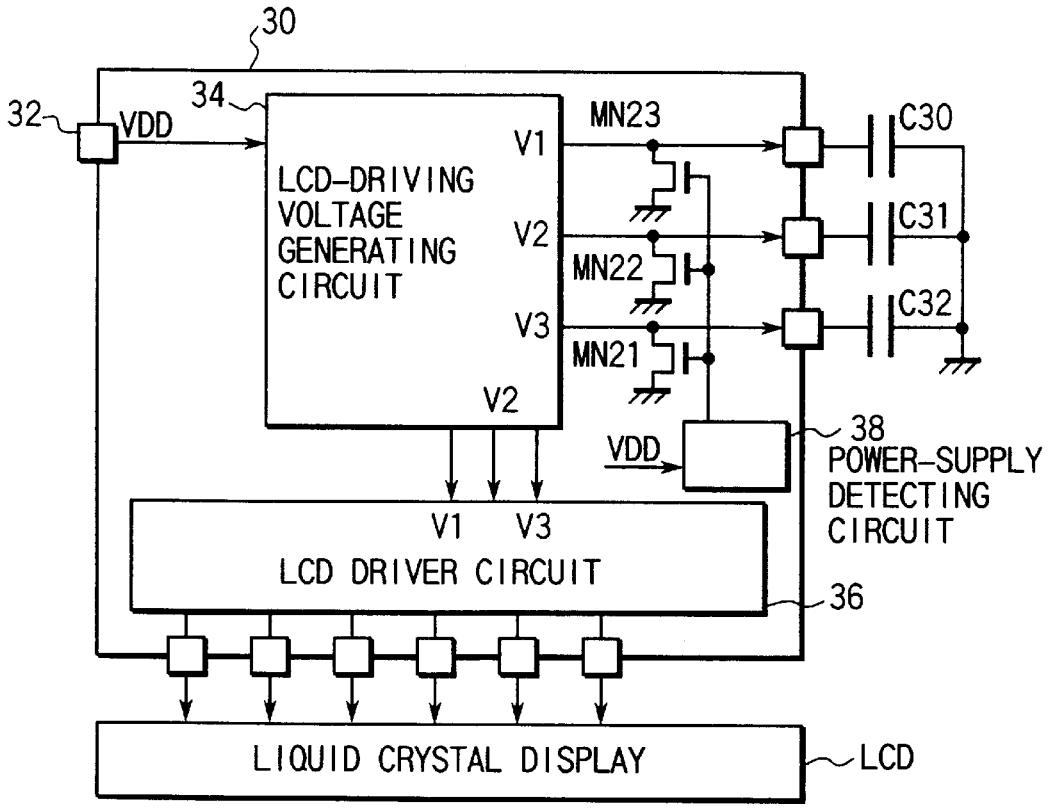
FIG. 12 is a block illustrating an LCD-driving circuit according to a fourth embodiment of the present invention.
Figure 13:
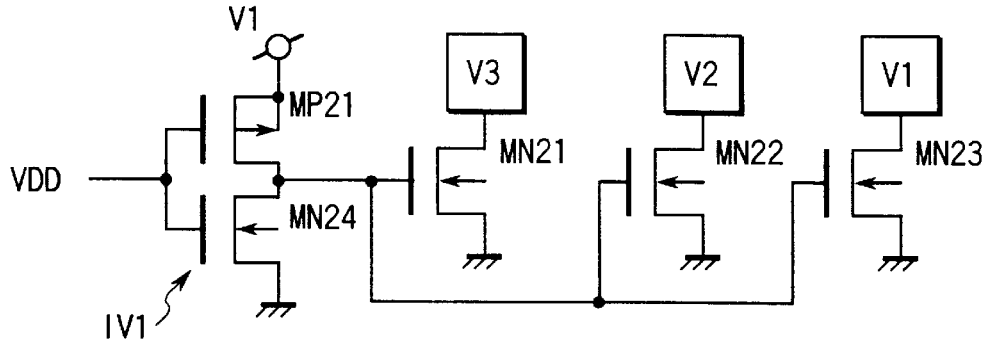
FIG. 13 is a diagram depicting the pull-down transistors and the power-supply detecting circuit, which are provided in the fourth embodiment.

FIG. 12 is a block diagram illustrating the fourth embodiment. As shown in FIG. 12, the LCD-driving circuit comprises an input terminal 32, an LCD-driving voltage generating circuit 34, a LCD driver circuit 36, voltage-holding capacitors C30, C31 and C32, n-channel MOS transistors MN21, MN22 and MN23, and a power-supply detecting circuit 38. Of these components, the components 32, 34, 36, MN21, MN22 and MN23 are incorporated in a semiconductor large-scale integrated circuit (LSI) 30, while the components C30, C31 and C32 are provided outside the large-scale integrated circuit 30.

The LCD-driving voltage generating circuit 34 generates LCD-driving voltages V1, V2 and V3 from the power-supply voltage VDD applied to the input terminal 32 from an external device. The LCD driver circuit 36 receives the LCD-driving voltages V1, V2 and V3 and outputs a display signal to an liquid crystal display LCD. The capacitors C30, C31 and C32 are provided to accumulate and stabilize the LCD-driving voltages V1, V2 and V3, respectively. The n-channel MOS transistors MN21, MN2 and MN3 are switching transistors. The transistor MN21 is connected between the circuit 34 and the capacitor C32, for dropping the voltage V3 to the reference voltage GND or holding the same in the capacitor C32. The transistor MN22 is connected between the circuit 34 and the capacitor C31, for dropping the voltage V2 to the reference voltage GND or holding the same in the capacitor C31. The transistor MN23 is connected between the circuit 34 and the capacitor C320, for dropping the voltage V1 to the reference voltage GND or holding the same in the capacitor C30. The power-supply detecting circuit 38 detects whether the power-supply voltage VDD is less than the lowest operating voltage of the LCD-driving circuit. The circuit 38 supplies an on-signal to the transistors MN21, MN22 and MN23 when the voltage VDD is equal to or more than the lowest operating voltage, and supplies an off-signal when the voltage VDD is less than the lowest operating voltage.

The transistors MN21, MN22 and MN23 and the power-supply detecting circuit 38 will be described in more detail, with reference to FIG. 13. As shown in FIG. 13, the power-supply detecting circuit 38 is an inverter IV1 which is composed of a p-channel MOS transistor MP21 and an n-channel MOS transistor MN24. These transistors 21 and 24 have their gates connected to receive the power-supply voltage VDD. The transistor 21 has its source and back gate connected to receive the LCD-driving voltage V1. The drains of the transistors 21 and 24 are connected to the gates of the gates of the n-channel MOS transistors MN21, MN22 and MN23.

The LCD-driving voltage V3 is applied to the drain of the n-channel MOS transistor MN21, the LCD-driving voltage V2 to the drain of the n-channel MOS transistor MN22, and the LCD-driving voltage V1 to the drain of the n-channel MOS transistor MN23. The sources of the n-channel MOS transistors MN21, MN22, MN23 and MN24 are connected to the GND line.

As indicated above, the power-supply voltage VDD is applied to the gates of the transistors MP21 and MN24 which constitute the inverter IV1. The inverter IV1, whose power-supply voltage is the LCD-driving voltage V1, functions as the power-supply detecting circuit 38. The output of the circuit 38 is applied to the gate of the pull-down transistor MN21 provided between the GND line and the line which applies the LCD-driving voltage V3. It is applied to the gate of the pull-down transistor MN22 provided between the GND line and the line applyhing the LCD-driving voltage V2, too. Also is it applied to the gate of the pull-down transistor MN23 provided between the GND line and the line applying the LCD-driving voltages V1.

The operation of the LCD-driving circuit according to the fourth embodiment will be explained, with reference to FIG. 14.

In the fourth embodiment, the power-supply voltage VDD is 5V, a nd the LCD-driving voltages V1, V2 and V3 are 1 V, 2V, and 3V, respectively. Namely, the voltage V2 is twice as high as the voltage V1, and the voltage V3 is thrice as high as the voltage V1.

Figure 14:
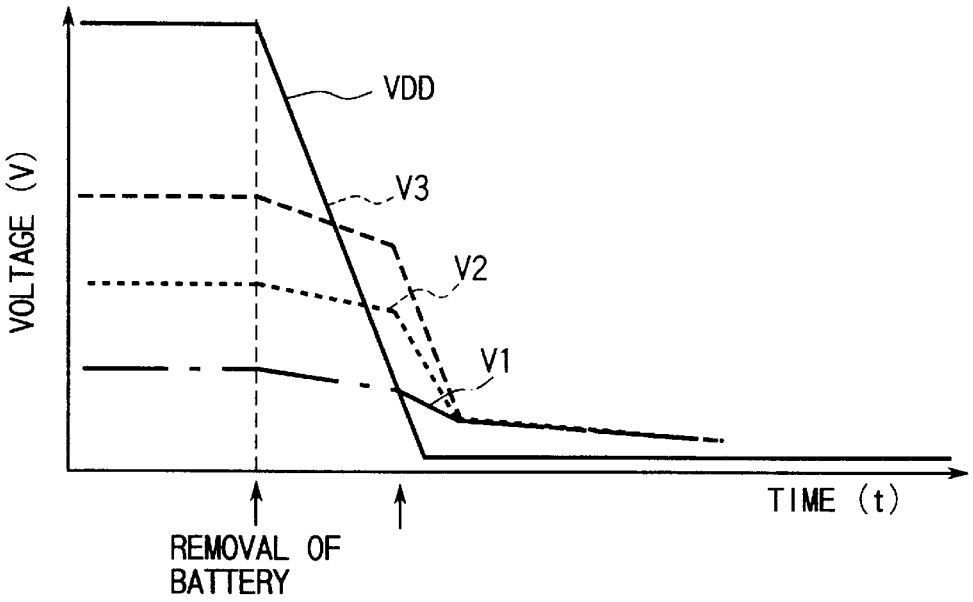
FIG. 14 is a graph illustrating how the power-supply voltage VDD and the LCD-driving voltages V1, V2 and V3 change with time in the fourth embodiment.

FIG. 14 is a graph illustrating how the power-supply voltage VDD and the LCD-driving voltages V1, V2 and V3 change with time in the fourth embodiment.

The power-supply voltage VDD, which is usually 5V, is applied to the gate of the inverter IV1. The output of the inverter IV1 then becomes equal to the reference voltage GND (0V). The pull-down transistors MN21, MN22 and MN23 are thereby turned off. No conducting path is formed between the source and drain of each of these transistor. Hence, as shown in FIG. 14, the LCD-driving voltages V3, V2 and V1 remain held in the capacitors C32, C31 and C30, respectively.

Assume the battery (i.e., the power supply) is abruptly removed from the LCD-driving circuit. Then, the application of the power-supply voltage VDD is interrupted, whereby the power-supply voltage VDD sharply falls to the reference voltage GND as is illustrated in FIG. 14. At the time the voltage VDD starts falling, the LCD-driving voltages V1, V2 and V3, which the LCD-driving voltage generating circuit 34 has generated and which the capacitors C30, C31 and C32 hold, respectively, start lowering slowly due to a leakage current.

When the power-supply voltage VDD falls below the voltage V1, the output of the inverter IV1 whose power-supply voltage is Vi gradually changes from the reference voltage GND to the LCD-driving voltage V1. Then, the n-channel MOS transistors MN21, MN22 and MN23 applied with the voltages V3, V2 and V1, respectively, are turned on. A conducting path is formed between the drain and source of each of these transistors. The lines applying the voltages V1, V2 and V3 are short-circuited to the GND line. The electric charges are thereby discharged from the capacitors C30, C31 and C32 to the ground, and the voltages V1, V2 and V3 fall to the reference voltage GND.

As described above, conducting paths are formed in the fourth embodiment when the application of the power-supply voltage is interrupted. Through the conducting paths, thus formed, electric charges are discharged from the LCD-voltage holding capacitors, whereby no LCD-driving voltages are applied unnecessarily to the liquid crystal display. This can prevent undesired phenomena, such as flickering, from occurring on the screen of the liquid crystal display.

An LCD-driving circuit, which is the fifth embodiment of the invention, will be described with reference to FIG. 15.

In the fourth embodiment, pull-down transistors are used to lower the LCD-driving voltages V1, V2 and V3 to the reference voltage GND. In the fifth embodiment, pull-down transistors need not be connected to the lines applying all LCD-driving voltages V1, V2 and V3. Rather, it suffices to connect at lease one pull-down transistor to at least one of the lines which apply the voltages V1, V2 and V3.

Figure 15:
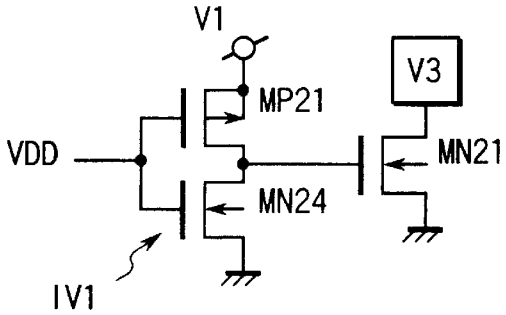
FIG. 15 is a diagram showing the pull-down transistors and the power-supply detecting circuit, which are provided in an LCD-driving circuit according to a fifth embodiment of the present invention.

FIG. 15 is a diagram showing the pull-down transistor and the power-supply detecting circuit, which are provided in the fifth embodiment. As shown in FIG. 15, the power-supply detecting circuit 38 is an inverter circuit IV1 identical to the one incorporated in the fourth embodiment. That is, the circuit IV1 comprises a p-channel MOS transistor MP21 and an n-channel MOS transistor MN24. The gates of the transistors MP21 and MN24 are connected to receive the power-supply voltage VDD. The source and back gate of the transistor MP21 are connected to receive an LCD-driving voltage V1. The drains of the transistors MP21 and MN24 are connected to the gate of an n-channel MOS transistor MN21.

The drain of the n-channel MOS transistor MN21 is connected to the line applying an LCD-driving voltage V3. The sources of the n-channel MOS transistors MN24 and MN21 are connected to the GND line.

As indicated above, the power-supply voltage VDD is applied to the gates of the transistors MP21 and MN24 constituting the inverter circuit IV1. The inverter circuit IV1, whose power-supply voltage is the LCD-driving voltage V1, functions as the power-supply detecting circuit 38. The output of the circuit 38 is supplied to the gate of the transistor MN21 which is used as a pull-down transistor and which is provided between the line applying the LCD-driving voltage V3 and the GND line. Except for these points, the fifth embodiment is identical in structure to the fourth embodiment.

The operation of LCD-driving circuit according to the firth embodiment will be explained.

The power-supply voltage VDD is 5V, and the LCD-driving voltages V1, V2 and V3 are 1 V, 2V, and 3V, respectively, as in the fourth embodiment. That is, the voltage V2 is twice as high as the voltage V1, and the voltage V3 is thrice as high as the voltage V1.

The power-supply voltage VDD, which is usually 5V, is applied to the gate of the inverter IV1 which is composed of the p-channel MOS transistor MP21 and the n-channel MOS transistor MN24. The output of the inverter IV1 becomes equal to the reference voltage GND (0V). The pull-down transistor MN21 is thereby turned off. No conducting path is formed between the source and drain of the transistor MN21. The LCD-driving voltage V3 therefore remains held in the capacitor C32.

Assume the battery (i.e., the power supply) is abruptly removed from the LCD-driving circuit. Then, the application of the power-supply voltage VDD is interrupted, whereby the power-supply voltage VDD sharply falls to the reference voltage GND. At the time the voltage VDD starts falling, the LCD-driving voltage V3, which the LCD-driving voltage generating circuit 34 has generated and which the capacitor C32 holds starts lowering slowly due to a leakage current.

When the power-supply voltage VDD falls below the voltage V1, the output of the inverter IV1 whose power-supply voltage is V1 gradually changes from the reference voltage GND to the LCD-driving voltage V1. Then, the n-channel MOS transistor MN21 applied with the voltage V3 us turned on. A conducting path is formed between the drain and source of the transistor MN21. The line applying the voltage V3 is short-circuited to the GND line. The electric charge is thereby discharged from the capacitor C32 to the ground, and the voltage V3 fall to the reference voltage GND.

As described above, a conducting path is formed in the fifth embodiment when the application of the power-supply voltage is interrupted. Through the conducting path, thus formed, an electric charge is discharged from the LCD-voltage holding capacitor, whereby no LCD-driving voltage is applied unnecessarily to the liquid crystal display. This can prevent undesired phenomena, such as flickering, from occurring on the screen of the liquid crystal display.

An LCD-driving circuit according to the sixth embodiment of the invention will be described, with reference to FIGS. 16 and 17.

Figure 16:
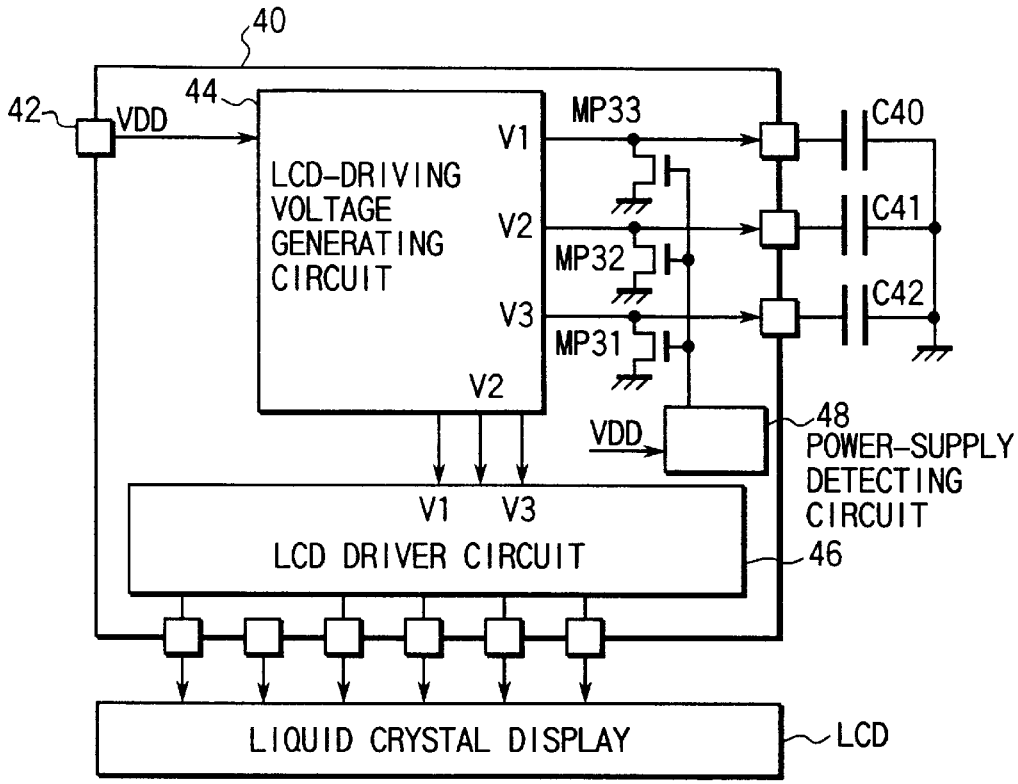
FIG. 16 is a diagram depicting an LCD-driving circuit according to a fifth embodiment of this invention.
Figure 17:
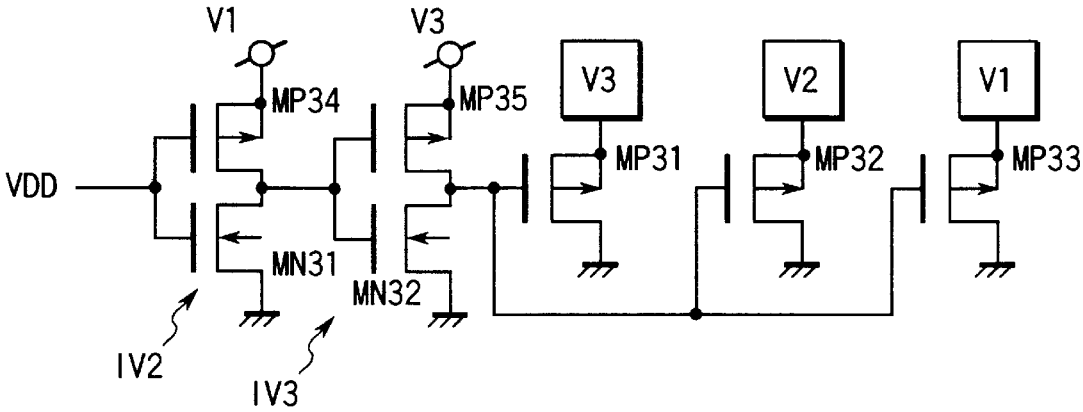
FIG. 17 is a diagram showing the pull-down transistors and the power-supply detecting circuit, which are provided in the fifth embodiment.

As shown in FIG. 16, the sixth embodiment comprises an input terminal 42, an LCD-driving voltage generating circuit 44, a LCD driver circuit 46, voltage-holding capacitors C40, C41 and C42, p-channel MOS transistors MP31,MP32 and MP33, and a power-supply detecting circuit 48. Of these components, the components 42, 44, 46, MP31, MP32 and MP33 are incorporated in a semiconductor large-scale integrated circuit (LSI) 40, while the components C40, C41 and C42 are provided outside the large-scale integrated circuit 40.

The LCD-driving voltage generating circuit 44 generates LCD-driving voltages V1, V2 and V3 from the power-supply voltage VDD applied to the input terminal 42 from an external device. The LCD driver circuit 46 receives the LCD-driving voltages V1, V2 and V3 and outputs a display signal to an liquid crystal display LCD. The capacitors C40, C41 and C42 are provided to accumulate and stabilize the LCD-driving voltages V1, V2 and V3, respectively. The p-channel MOS transistors MP31, MP32 and MP33 are switching transistors. The transistor MP31 is connected between the circuit 44 and the capacitor C42, for dropping the voltage V3 to the reference voltage GND or holding the same in the capacitor C32. The transistor MP32 is connected between the circuit 44 and the capacitor C41, for dropping the voltage V2 to the reference voltage GND or holding the same in the capacitor C31. The transistor MP33 is connected between the circuit 44 and the capacitor C40, for dropping the voltage V1 to the reference voltage GND or holding the same in the capacitor C30. The power-supply detecting circuit 48 detects whether the power-supply voltage VDD is less than the lowest operating voltage of the LCD-driving circuit. The circuit 38 supplies an on-signal to the transistors MN21, MN22 and MN23 when the voltage VDD is equal to or more than the lowest operating voltage, and supplies an off-signal when the voltage VDD is less than the lowest operating voltage.

The transistors MP31, MP32 and MP33 and the power-supply detecting circuit 48 will be described in more detail, with reference to FIG. 17. As shown in FIG. 17, the power-supply detecting circuit 48 comprises two inverter circuits IV2 and IV3. The inverter circuit IV2 is composed of a p-channel MOS transistor MP34 and an n-channel MOS transistor MN3. The inverter circuit IV3 is composed of a p-channel MOS transistor MP35 and an n-channel MOS transistor MN32.

The gates of the transistors MP34 and MN31 are connected to receive the power-supply voltage VDD. The source and back gate of the transistor MP34 are connected to receive the LCD-driving voltage V1. The drains of the transistors MP34 and MN31 are connected to the gates of the transistors MP35 and MN32. The source and back gate of the transistor MP35 are connected to receive the LCD-driving voltage V3.

The drains of the transistors MP35 and MN32 are connected to the gates of the p-channel MOS transistors MP31, MP32 and MP33. The source and back gate of the p-channel MOS transistor MP31 are connected to receive the LCD-driving voltage V3. The source and back gate of the p-channel MOS transistor MP32 are connected to receive the LCD-driving voltage V2. The source and back gate of the p-channel MOS transistor MP33 are connected to receive the LCD-driving voltage V1. The sources of the n-channel MOS transistors MN31 and MN32 are connected to receive the reference voltage GND. The drains of the p-channel MOS transistors MP31, MP32 and MP33 are connected to receive the reference voltage GND.

As described above, the power-supply voltage VDD is applied to the gates of the p-channel MOS transistors MP34 and n-channel MN31 which constitute the inverter circuit IV2. The output of the inverter circuit IV2 is input to the gates of the p-channel MOS transistors MP35 and n-channel MOS transistor MN32 which constitute the inverter circuit IV3. The inverters IV2 and IV3 constitute the power-supply detecting circuit 48. The output of the power-supply detecting circuit 48 is connected to the gates of the pull-down transistors MP31, MP32 and MP33 which are provided between the lines applying the LCD-driving voltages V3, v2 and V1, on the one hand, and the ground, i.e., the GND line, on the other hand.

The operation of the sixth embodiment will be explained below.

The power-supply voltage VDD is 5V, and the LCD-driving voltages V1, V2 and V3 are 1 V, 2V, and 3V, respectively, as in the fourth embodiment. Namely, the voltage V2 is twice as high as the voltage V1, and the voltage V3 is thrice as high as the voltage V1.

The power-supply voltage VDD, which is usually 5V, is applied to the gate of the p-channel MOS transistor MP34 and n-channel MOS transistor MN31 which constitute the inverter circuit IV2. The output of the inverter IV2 becomes equal to the reference voltage GND (0V). The reference voltage GND is applied to the gates of the p-channel MOS transistor MP35 and n-channel MOS transistor MN32 which constitute the inverter circuit IV3. The output of the inverter circuit MV3 changes to V3. The pull-down transistors MP31, PM32 and MP33 are turned off. No conducting paths are therefore formed between the sources of these transistors MP31, MP32 and MP33, on the one hand, and the drains thereof, on the other. As a result, the LCD-driving voltages V3, V2 and V1 remain held in the capacitors C42, C41 and C40, respectively.

Assume the battery (i.e., the power supply) is abruptly removed from the LCD-driving circuit. The application of the power-supply voltage VDD is then interrupted, whereby the power-supply voltage VDD sharply falls to the reference voltage GND, as is illustrated in FIG. 14. At the time the voltage VDD starts falling, the LCD-driving voltages V1, V2 and V3 which the LCD-driving voltage generating circuit 44 has generated and which the capacitors C40, C41 and C42 hold start lowering slowly due to a leakage current.

When the power-supply voltage VDD falls below the voltage V1, the output of the inverter IV2 whose power-supply voltage is Vi gradually changes from the reference voltage GND to the LCD-driving voltage V1. The output of the inverter IV3 gradually lowers to the reference voltage GND.

Then, the p-channel MOS transistors MP31, MP32 and MP33 receiving the LCD-driving voltages V3, V2 and V1, respectively, are turned on. A conducting path is formed between the drain and source of each of these transistors MP31, MP32 and MN21. The lines applying the voltage V3, V2 and V1 are short-circuited to the GND line. The electric charges are thereby discharged from the capacitor C40, C41 and C42 to the ground. The voltages V1, V2 and V3 fall to the reference voltage GND.

As mentioned above, conducting paths are formed in the sixth embodiment when the application of the power-supply voltage is interrupted. Through the conducting paths, thus formed, electric charges are discharged from the LCD-voltage holding capacitors, whereby no LCD-driving voltage is applied unnecessarily to the liquid crystal display. This can prevent undesired phenomena, such as flickering, from occurring on the screen of the liquid crystal display.

An LCD-driving circuit, which is the seventh embodiment of the invention, will be described with reference to FIG. 18.

In the sixth embodiment, pull-down transistors are used to lower the LCD-driving voltages V1, V2 and V3 to the reference voltage GND. In the seventh embodiment, pull-down transistors need not be connected to the lines applying all LCD-driving voltages V1, V2 and V3. Rather, it suffices to connect at lease one pull-down transistor to at least one of the lines which apply the voltages V1, V2 and V3.

Figure 18:
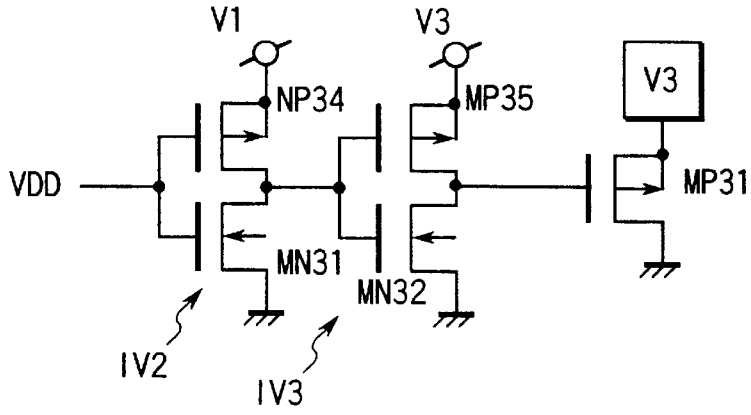
FIG. 18 is a diagram depicting the pull-down transistors and the power-supply detecting circuit, which are provided in an LCD-driving circuit according to a seventh embodiment of this invention.
Figure 19:
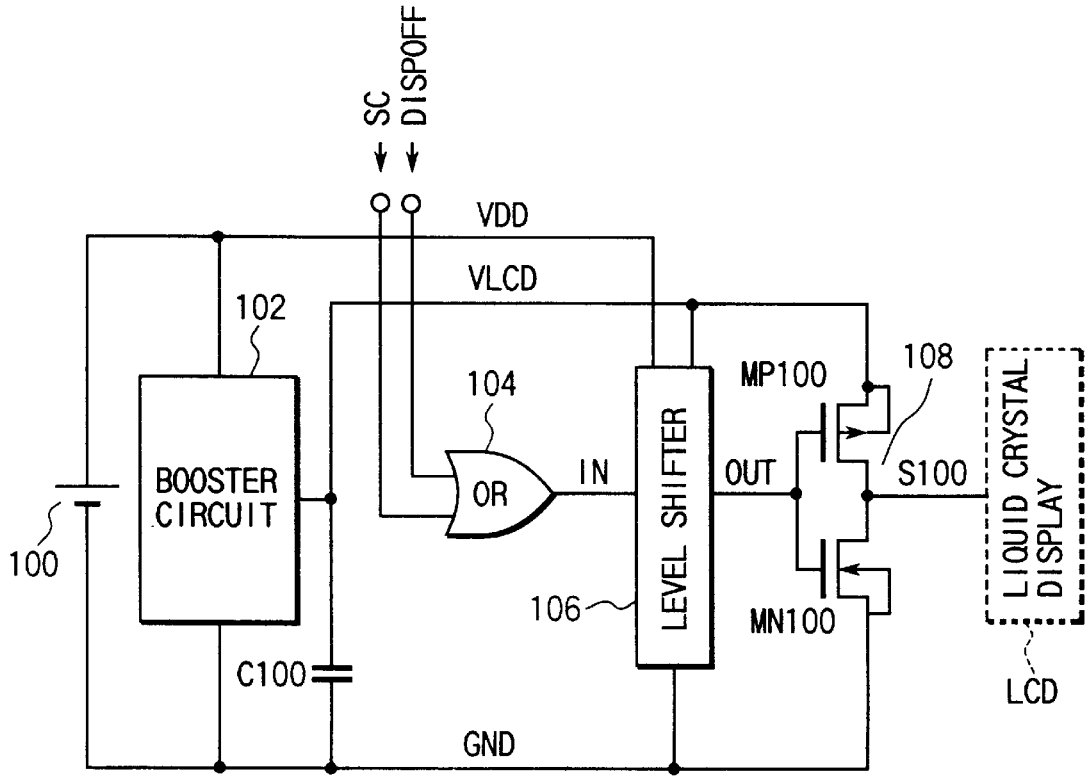
FIG. 19 is a circuit diagram showing a conventional LCD-driving circuit.
Figure 20:
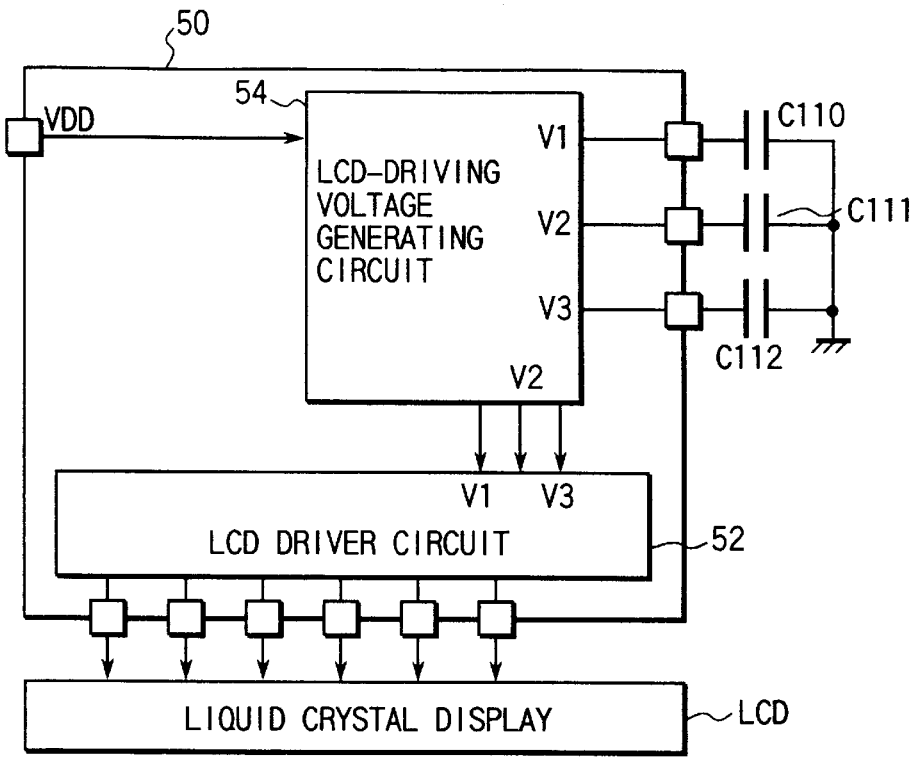
FIG. 20 is a block diagram another conventional LCD-driving circuit.
Figure 21:
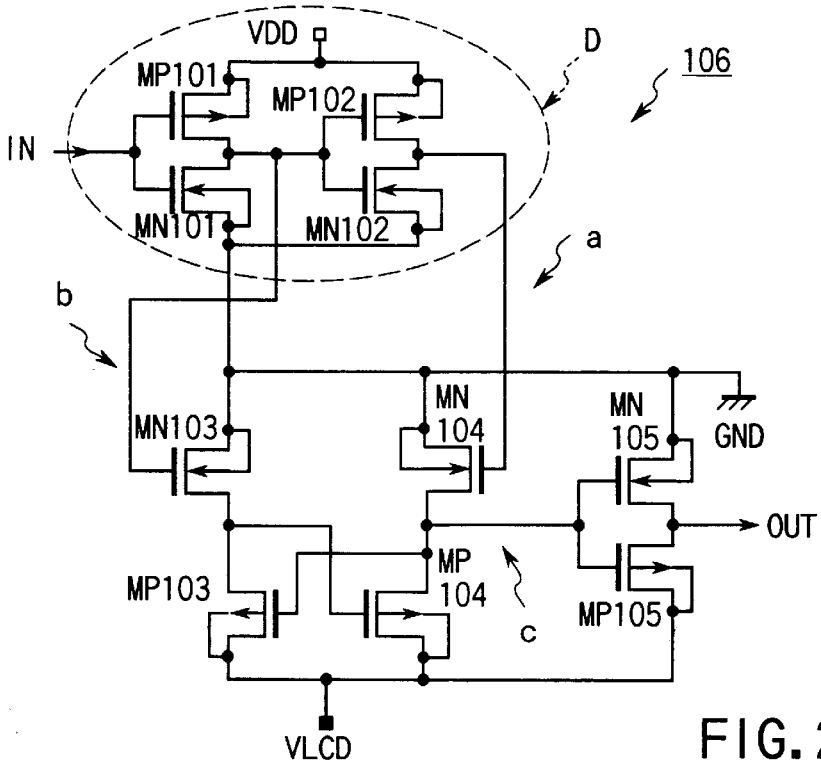
FIG. 21 is a circuit diagram of the level shifter incorporated in the convention LCD-driving circuit shown in FIG. 19.
Figure 22:
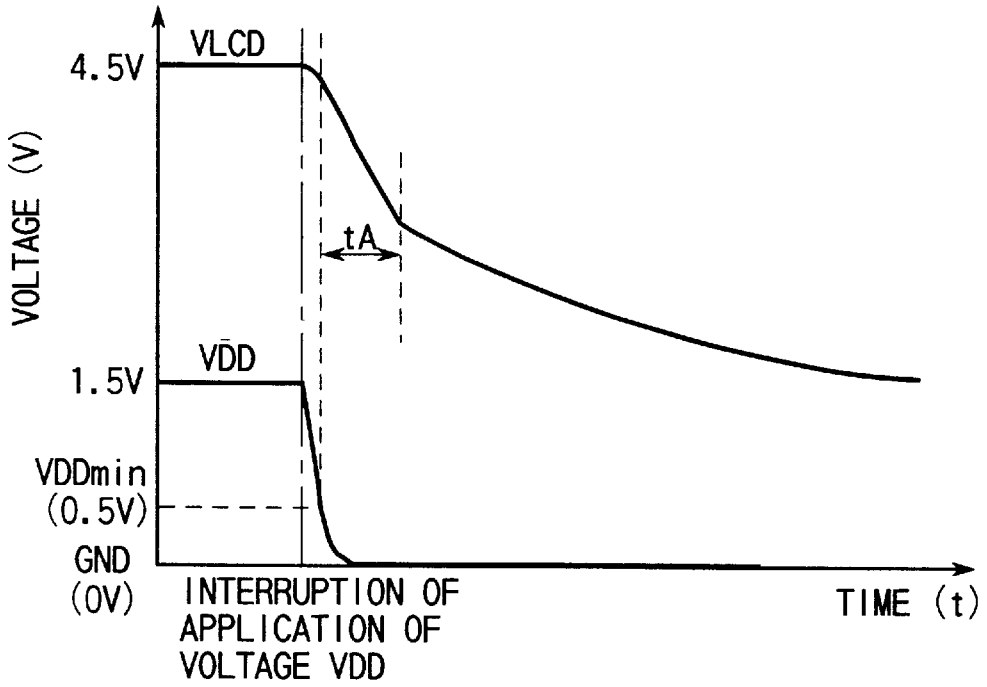
FIG. 22 is a graph showing how the power-supply voltage VDD and the LCD-driving voltage VLCD change when the application of the power-supply voltage VDD is interrupted after the liquid crystal display has been turned off in the LCD-driving circuit shown in FIG. 19.
Figure 23:
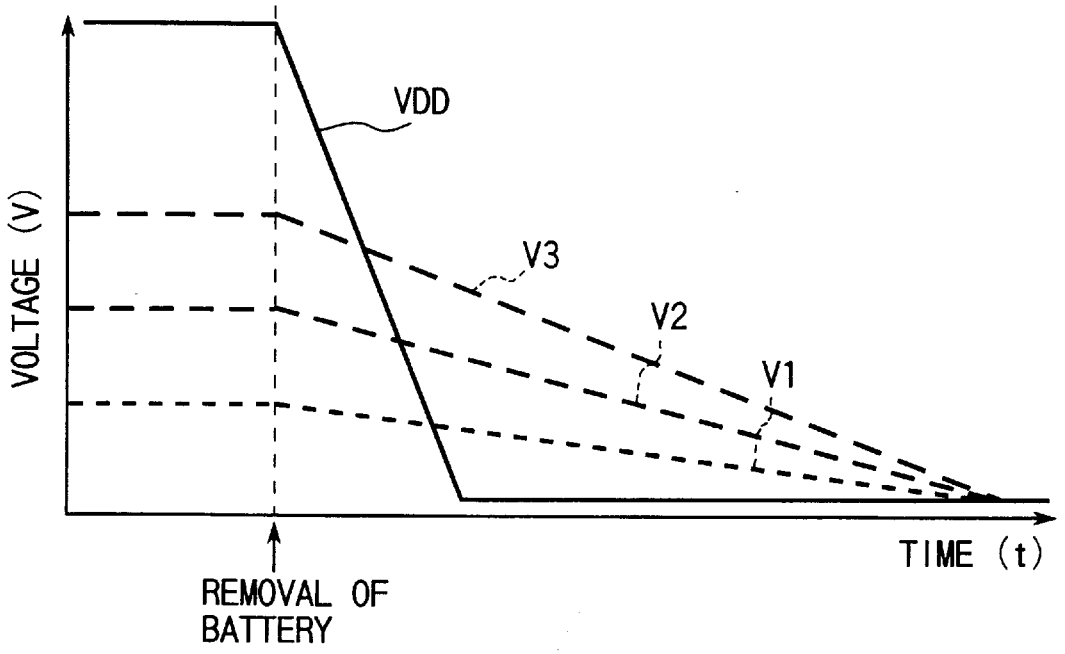
FIG. 23 is a graph illustrating how the power-supply voltage VDD and the LCD-driving voltage VLCD change when the application of the power-supply voltage VDD is interrupted after the liquid crystal display has been turned off in the LCD-driving circuit shown in FIG. 20.

FIG. 18 is a diagram showing the pull-down transistor and the power-supply detecting circuit, which are provided in the seventh embodiment. As shown in FIG. 18, the power-supply detecting circuit 48 comprises two inverter circuits IV2 and IV3. The inverter circuit IV2 is composed of a p-channel MOS transistor MP34 and an n-channel MOS transistor MN31. The inverter circuit IV3 is composed of a p-channel MOS transistor MP35 and an n-channel MOS transistor MN32.

The gates of the transistors MP34 and MN31 are connected to receive the power-supply voltage VDD. The source and back gate of the transistor MP34 are connected to receive the LCD-driving voltage V1. The drains of the transistors MP34 and MN31 are connected to the gates of the transistors MP35 and MN32. The source and back gate of the transistor MP35 are connected to receive the LCD-driving voltage V3.

The drains of the transistors MP35 and MN32 are connected to the gate of the p-channel MOS transistor MP31. The source and back gate of the p-channel MOS transistor MP31 are connected to receive the LCD-driving voltage V3. The n-channel MOS transistors MN31 and MN32 have their sources connected to receive the reference voltage GND. The drain of the p-channel MOS transistor MP31 is connected to receive the reference voltage GND.

As described above, the power-supply voltage VDD is applied to the gates of the p-channel MOS transistors MP34 and p-channel MOS transistor MN31 which constitute the inverter circuit IV2. The output of the inverter circuit IV2 is input to the gates of the p-channel MOS transistors MP35 and n-channel MOS transistor MN32 which constitute the inverter circuit IV3. The inverters IV2 and IV3 constitute the power-supply detecting circuit 48. The output of the power-supply detecting circuit 48 is connected to the gate of the pull-down transistor MP31 which is provided between the line applying LCD-driving voltage V3 and the GND line. Except for these points, the seventh embodiment is identical in structure to the sixth embodiment.

The operation of the seventh embodiment will be explained below.

The power-supply voltage VDD is 5V, and the LCD-driving voltages V1, V2 and V3 are 1 V, 2V, and 3V, respectively, as in the fourth embodiment. Namely, the voltage V2 is twice as high as the voltage V1, and the voltage V3 is thrice as high as the voltage V1.

The power-supply voltage VDD, which is usually 5V, is applied to the gates of the p-channel MOS transistor MP34 and n-channel MOS transistor MN31 which constitute the inverter circuit IV2. The output of the inverter IV2 becomes equal to the reference voltage GND (0V). The reference voltage GND is applied to the gates of the p-channel MOS transistor MP35 and n-channel MOS transistor MN32 which constitute the inverter circuit IV3. The output of the inverter circuit IV3 changes to V3. The pull-down transistor MP31 is turned off. No conducting path is there fore formed between the source and drain of the transistor MP31. As a result, the LCD-driving voltage V3 remains held in the capacitor C42.

Assume the charged battery is abruptly removed from the LCD-driving circuit. The application of the power-supply voltage VDD is then interrupted, whereby the power-supply voltage VDD sharply falls to the reference voltage GND, as is illustrated in FIG. 14. At the time the voltage VDD starts falling, the LCD-driving voltage V3, which the LCD-driving voltage generating circuit 44 has generated and which the C42 holds, starts lowering slowly due to a leakage current.

When the power-supply voltage VDD falls below the voltage V1, the output of the inverter IV2 whose power-supply voltage is V1 gradually changes from the reference voltage GND to the LCD-driving voltage V1. The output of the inverter IV3 therefore gradually lowers to the reference voltage GND.

Then, the p-channel MOS transistors MP31 receiving the LCD-driving voltage V3 is turned on. A conducting path is formed between the drain and source of the transistor MP31. The lines applying the voltage V3 is short-circuited to the GND line. The electric charge is thereby discharged from the capacitor C42 to the ground. The voltage V3 falls to the reference voltage GND.

As described above, a conducting path is formed in the seventh embodiment when the application of the power-supply voltage is interrupted. Through the conducting path, thus formed, an electric charge is discharged from the LCD-voltage holding capacitor, whereby no LCD-driving voltage is applied unnecessarily to the liquid crystal display. This can prevent undesired phenomena, such as flickering, from occurring on the screen of the liquid crystal display.

In the sixth and seventh embodiments described above, at least one p-channel MOS transistor is used as a pull-down transistor. Therefore, the LCD-driving voltages V1, V2 and V3 finally change to the threshold voltage VthP of the p-channel MOS transistor when the power-supply voltage VDD falls.

In the fourth to seventh embodiments, the reference voltage for the power-supply detecting circuit is set at V1 because the lowest operating voltage of the LCD-driving circuit is V1. The present invention is not limited to this scheme. Rather, any other voltage can be set as the reference voltage for the power-supply detecting circuit in accordance with the lowest operating voltage of the LCD-driving circuit. For example, the voltage V2 may be set as such if the lowest operating voltage of the circuit is V2, and the voltage V3 may be set as such if the lowest operating voltage of the circuit is V3. In whichever case, the same advantages can be accomplished.

Further, the same advantages can be attained if the output voltage of any other constant-voltage circuit used may be set as the reference voltage for the power-supply detecting circuit.

Any LCD-driving circuit according to the invention, described above, can prevent a liquid crystal display from causing undesired phenomena on its screen. This is because the LCD-driving voltages V1, V2 and V3 are discharged from the capacitors when the application of the power-supply voltage VDD is interrupted and the power-supply voltage inevitably falls below the lowest operating voltage of the LCD-driving circuit.

As has been described, the present invention can provide an LCD-driving circuit in which a path is formed to discharge a electric charge from the LCD-driving voltage holding capacitor when the application of the power-supply voltage is interrupted, and which can therefore prevent flickering from occurring on the screen of a liquid crystal display.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A circuit for driving a liquid crystal display, comprising:

a first line for applying a power-supply voltage;

a second line for applying a reference voltage;

voltage-generating means connected between the first line and the second line, for generating from the power-supply voltage an LCD-driving voltage which drives liquid crystal incorporated in a liquid crystal display;

a third line connected to said voltage-generating means, for applying the LCD-driving voltage;

a level-shifting circuit connected to said first line, for outputting a signal having a level that corresponds to a level of the power-supply voltage applied from the first line; and switch means for disconnecting said third line from or short-circuiting the same to the second line in response to the signal output from said level-shifting circuit.

2. A circuit according to claim 1, wherein said voltage-generating means generates a plurality of different voltages.

3. A circuit according to claim 2, wherein said switch means disconnects a line for applying the highest of the different voltages, from the second line, or short-circuits the same to the second line, in response to the output of said level-shifting circuit.

4. A circuit according to claim 2, wherein said switch means disconnects lines for applying the different voltages, from the second line, or short-circuits the same to the second line, in response to the output of said level-shifting circuit.

5. A circuit according to claim 2, wherein the different voltages are a first voltage, second voltage, and third voltage.

6. A circuit according to claim 5, wherein said switch means disconnects a line for applying the highest of the first to third voltages, from the second line, or short-circuits the same to the second line, in response to the output of said level-shifting circuit.

7. A circuit according to claim 5, wherein said switch means disconnects lines for applying the first to third voltages, from the second line, or short-circuits the same to the second line, in response to the output of said level-shifting circuit.

8. A circuit according to claim 1, wherein said level-shifting circuit is an inverter.

9. A circuit according to claim 1, wherein said switch means is an MOS transistor provided between said third line and said second line.

10. A circuit for driving a liquid crystal display, comprising:

a first line for applying a power-supply voltage;

a second line for applying a reference voltage;

voltage-generating means connected between the first line and the second line, for generating from the power-supply voltage an LCD-driving voltage which drives liquid crystal incorporated in a liquid crystal display;

a third line connected to said voltage-generating means, for applying the LCD-driving voltage;

a level-shifting circuit connected to said first line, for outputting a first signal when the power-supply voltage is equal to or higher than a predetermined voltage and a second signal when the power-supply voltage is lower than the predetermined voltage; and switch means for disconnecting said third line from the second line when an output of said level-shifting circuit is the first signal, and for short-circuiting said third line to the second line when an output of said level-shifting circuit is the second signal.

11. A circuit according to claim 10, wherein said first signal is the LCD-driving voltage, and said second signal is the reference voltage.

12. A circuit according to claim 10, wherein said voltage-generating means generates a plurality of different LCD-driving voltages.

13. A circuit according to claim 12, wherein said switch means disconnects a line for applying the highest of the different LCD-driving voltages, from the second line in response to the first signal output from said level-shifting circuit, and short-circuits the same to the second line in response to the second signal output from said level-shifting circuit.

14. A circuit according to claim 12, wherein said switch means disconnects lines for applying the different LCD-driving voltages, from the second line in response to the first signal output from said level-shifting circuit, and short-circuits the same to the second line in response to the second signal output from said level-shifting circuit.

15. A circuit according to claim 10, wherein the different voltages are a first voltage, second voltage, and third voltage.

16. A circuit according to claim 15, wherein said switch means disconnects a line for applying the highest of the first to third voltages, from the second line in response to the second signal output from said level-shifting circuit, or short-circuits the same to the second line in response to the second signal output from said level-shifting circuit.

17. A circuit according to claim 15, wherein said switch means disconnects lines for applying the first to third voltages, from the second line in response to the second signal output from said level-shifting circuit, or short-circuits the same to the second line in response to the second signal output from said level-shifting circuit.

18. A circuit according to claim 10, wherein said level-shifting circuit is an inverter.

19. A circuit for driving a liquid crystal display, comprising:

a first line configured to apply a power-supply voltage;

a second line configured to apply a reference voltage;

a voltage-generating circuit connected between the first line and the second line, and configured to generate from the power-supply voltage an LCD-driving voltage which drives liquid crystal incorporated in a liquid crystal display;

a third line connected to said voltage-generating circuit, and configured to apply the LCD-driving voltage;

a level-shifting circuit connected to said first line, and configured to output a signal having a level that corresponds to a level of the power-supply voltage applied from the first line; and a switch configured to disconnect said third line from or short-circuiting the same to the second line in response to the signal output from said level-shifting circuit.

20. A circuit according to claim 19, wherein said voltage-generating circuit generates a plurality of different voltages.

21. A circuit according to claim 20, wherein said switch disconnects a line for applying the highest of the different voltages, from the second line, or short-circuits the same to the second line in response to the output of said level-shifting circuit.

22. A circuit according to claim 20, wherein said switch disconnects lines for applying the different voltages, from the second line, or short-circuits the same to the second line, in response to the output of said level-shifting circuit.

23. A circuit according to claim 20, wherein the different voltages are a first voltage, second voltage, and third voltage.

24. A circuit according to claim 23, wherein said switch disconnects a line for applying the highest of the first to third voltages, from the second line, or short-circuits the same to the second line in response to the output of said level-shifting circuit.

25. A circuit according to claim 23, wherein said switch disconnects lines for applying the first to third voltages, from the second line, or short-circuits the same to the second line in response to the output of said level-shifting circuit.

26. A circuit according to claim 19, wherein said level-shifting circuit is an inverter.

27. A circuit according to claim 19, wherein said switch is an MOS transistor provided between said third line and said second line.

28. A circuit for driving a liquid crystal display, comprising:

a first line configured to apply a power-supply voltage;

a second line configured to apply a reference voltage;

a voltage-generating circuit connected between the first line and the second line, and configured to generate from the power-supply voltage an LCD-driving voltage which drives liquid crystal incorporated in a liquid crystal display;

a third line connected to said voltage-generating circuit, and configured to apply the LCD-driving voltage;

a level-shifting circuit connected to said first line, and configured to output a signal when the power-supply voltage is equal to or higher than a predetermined voltage and second signal when the power-supply voltage is lower than the predetermined voltage; and a switch configured to disconnect said third line from the second line when an output of said level-shifting circuit is the first signal, and configured to short-circuit said third line to the second line when an output of said level-shifting circuit is the second signal.

29. A circuit according to claim 28, wherein said first signal is the LCD-driving voltage, and said second signal is the reference voltage.

30. A circuit according to claim 28, wherein said voltage-generating circuit generates a plurality of different LCD-driving voltages.

31. A circuit according to claim 30, wherein said switch disconnects a line for applying the highest of the different LCD-driving voltages, from the second line in response to the first signal output from said level-shifting circuit, and short-circuits the same to the second line in response to the second signal output from said level-shifting circuit.

32. A circuit according to claim 30, wherein said switch disconnects lines for applying the different LCD-driving voltages, from the second line in response to the first signal output from said level-shifting circuit, and short-circuits the same to the second line in response to the second signal output from said level-shifting circuit.

33. A circuit according to claim 28, wherein the different voltages are a first voltage, second voltage, and third voltage.

34. A circuit according to claim 33, wherein said switch disconnects a line for applying the highest of the first to third voltages, from the second line in response to the second signal output from said level-shifting circuit, or short-circuits the same to the second line in response to the second signal output from said level-shifting circuit.

35. A circuit according to claim 33, wherein said switch disconnects lines for applying the first to third voltages, from the second line in response to the second signal output from said level-shifting circuit, or short-circuits the same to the second line in response to the second signal output from said level-shifting circuit.

36. A circuit according to claim 28, wherein said level-shifting circuit is an inverter.

* * * * *